US008714135B2

(12) United States Patent
Anderson et al.

(10) Patent No.: US 8,714,135 B2
(45) Date of Patent: May 6, 2014

(54) IDAR-ACE INVERSE DISPLACEMENT ASYMMETRIC ROTATING ALTERNATIVE CORE ENGINE

(71) Applicant: Lumenium LLC, Warrenton, VA (US)

(72) Inventors: William Anderson, Warrenton, VA (US); William Lukaczyk, Warrenton, VA (US); Trent Lukaczyk, Warrenton, VA (US)

(73) Assignee: Lumenium LLC, Warrenton, VA (US)

( * ) Notice: Subject to any disclaimer, the term of this patent is extended or adjusted under 35 U.S.C. 154(b) by 0 days.

(21) Appl. No.: 13/868,359

(22) Filed: Apr. 23, 2013

(65) Prior Publication Data

US 2013/0251579 A1 Sep. 26, 2013

Related U.S. Application Data

(63) Continuation of application No. PCT/US2013/030649, filed on Mar. 13, 2013.

(60) Provisional application No. 61/697,481, filed on Sep. 6, 2012, provisional application No. 61/610,781, filed on Mar. 14, 2012.

(51) Int. Cl.
*F02B 53/00* (2006.01)
*F01C 1/46* (2006.01)
*F01C 19/00* (2006.01)

(52) U.S. Cl.
USPC ..... 123/228; 418/225; 418/237; 418/238; 418/242

(58) Field of Classification Search
USPC ..... 123/241, 248, 242, 228, 244, 229, 230, 123/237; 418/225, 237, 238, 242, 248, 250
See application file for complete search history.

(56) References Cited

U.S. PATENT DOCUMENTS 419,770 A * 1/1890 Hart el al. ..... 418/250
613,345 A * 11/1898 White ..... 418/242

(Continued)

FOREIGN PATENT DOCUMENTS

DE 2853930 A1 6/1980
DE 3236811 A1 * 5/1984 ..... F01C 9/00

(Continued)

OTHER PUBLICATIONS

International Search Report in related international application No. PCT/US2003/014906, mailed: Aug. 7, 2003.

(Continued)

*Primary Examiner* — Mary A Davis
(74) *Attorney, Agent, or Firm* — Brian R. Pollack; Day Pitney LLP

(57) ABSTRACT

The disclosure provides engines or pumps that includes a rotatable shaft defining a central axis A, the shaft having a first end and a second end. The shaft can have an elongate first island disposed thereon. The first island can have a body with a volume generally defined between front and rear surfaces that are spaced apart. The front and rear surfaces can lie in a plane parallel to a radial axis R. The perimeters of the front and rear surfaces can define a curved perimeter surface therebetween. The engine or pump can further include a front side plate disposed adjacent to the front surface of the first island, and a rear side plate disposed adjacent to the rear surface of the first island. The engine or pump also includes a first contour assembly disposed between the front side plate and the rear side plate.

27 Claims, 28 Drawing Sheets

START OF INTAKE
CRANK ANGLE = 0 DEG.

(56) References Cited

U.S. PATENT DOCUMENTS

| | | | | | |
|---|---|---|---|---|---|
| 709,773 | A | * | 9/1902 | Jones | 418/250 |
| 1,972,302 | A | * | 9/1934 | Hutchison, Jr. | 418/242 |
| 1,983,033 | A | * | 12/1934 | Hutchison, Jr. | 418/242 |
| 1,983,034 | A | * | 12/1934 | Hutchison, Jr. | 418/242 |
| 1,986,202 | A | * | 1/1935 | Hutchison, Jr. | 418/242 |
| 2,277,225 | A | * | 3/1942 | Green | 123/228 |
| 2,919,062 | A | | 12/1959 | Wilfred | |
| 3,186,385 | A | * | 6/1965 | Walker | 123/244 |
| 3,187,507 | A | * | 6/1965 | Martin Artajo | 418/242 |
| 3,245,389 | A | * | 4/1966 | Korf | 418/242 |
| 3,259,113 | A | | 7/1966 | Hamada | |
| 3,289,654 | A | | 12/1966 | Geiger | |
| 3,295,505 | A | | 1/1967 | Jordan | |
| 3,302,870 | A | * | 2/1967 | Schell | 418/242 |
| 3,405,692 | A | | 10/1968 | Paschke | |
| 3,636,930 | A | | 1/1972 | Okada | |
| 3,884,600 | A | | 5/1975 | Gray | |
| 3,981,645 | A | | 9/1976 | Herzner | |
| 4,055,156 | A | | 10/1977 | Salguero | |
| 4,144,866 | A | | 3/1979 | Hakner | |
| 4,850,447 | A | * | 7/1989 | Hirakushi et al. | 180/248 |
| 5,380,177 | A | | 1/1995 | Leroy et al. | |
| 5,423,298 | A | * | 6/1995 | Pahis | 123/244 |
| 5,540,199 | A | | 7/1996 | Penn | |
| 6,120,272 | A | * | 9/2000 | Gallardo | 418/248 |
| 6,758,188 | B2 | * | 7/2004 | Wooldridge | 123/228 |
| 7,051,698 | B2 | | 5/2006 | Ollis | |
| 7,621,255 | B2 | | 11/2009 | Bowley | |
| 2003/0188711 | A1 | * | 10/2003 | Chou | 123/228 |
| 2004/0011320 | A1 | | 1/2004 | Wooldridge | |
| 2010/0242897 | A1 | * | 9/2010 | Wooldridge et al. | 123/228 |
| 2012/0031369 | A1 | | 2/2012 | Ki | |

FOREIGN PATENT DOCUMENTS

| | | | |
|---|---|---|---|
| EP | 1 534 943 | | 1/2004 |
| FR | 2250892 | A1 | 6/1975 |
| IN | 255824 | A1 | 3/2013 |
| JP | 47-16570 | | 5/1972 |
| JP | 56-18772 | B1 | 5/1981 |
| JP | 61-210228 | A | 9/1986 |
| JP | 63-065665 | A | 3/1988 |
| JP | 2002-188454 | A | 7/2002 |
| JP | 4763829 | B2 | 8/2011 |
| WO | 02/052125 | A1 | 7/2002 |
| WO | 2004/007926 | A1 | 1/2004 |
| WO | 2010/111557 | A2 | 9/2010 |
| WO | 2010/128776 | A2 | 11/2010 |

OTHER PUBLICATIONS

International Preliminary Examination Report in related international application No. PCT/US2003/014906, received: Dec. 20, 2004.

Supplementary European Search Report in related European application No. 03 73 1157, completed Jul. 6, 2009.

Decision of Refusal in related JP patent application No. 2004-521437, mailed: Aug. 25, 2009.

European Communication pursuant to Article 94(3) EPC in related EP patent application No. EP 03731157.8, dated: Oct. 21, 2009.

Notice of Office Action in related Korean application No. 7021723/2004, transmitted: May 11, 2010.

First Examination Report in related Indian patent application 2959/CHENP/2004 (IN Patent No. 255824), dated: Jan. 23, 2012.

International Search Report in related international application No. PCT/US2010/028754, mailed: Mar. 26, 2012.

International Preliminary Report on Patentability and Written Opinion in related international application No. PCT/US2010/028754, issued: Apr. 17, 2012.

Non-Final Office Action in related U.S. Appl. No. 12/732,160, notification date: Nov. 23, 2012.

Final Office Action in related U.S. Appl. No. 12/732,160, notification date: Mar. 27, 2013.

Notice of Reasons for Rejection in related JP patent application No. 2004-521437, Dec. 2, 2008.

* cited by examiner

CRANK ANGLE = +45°

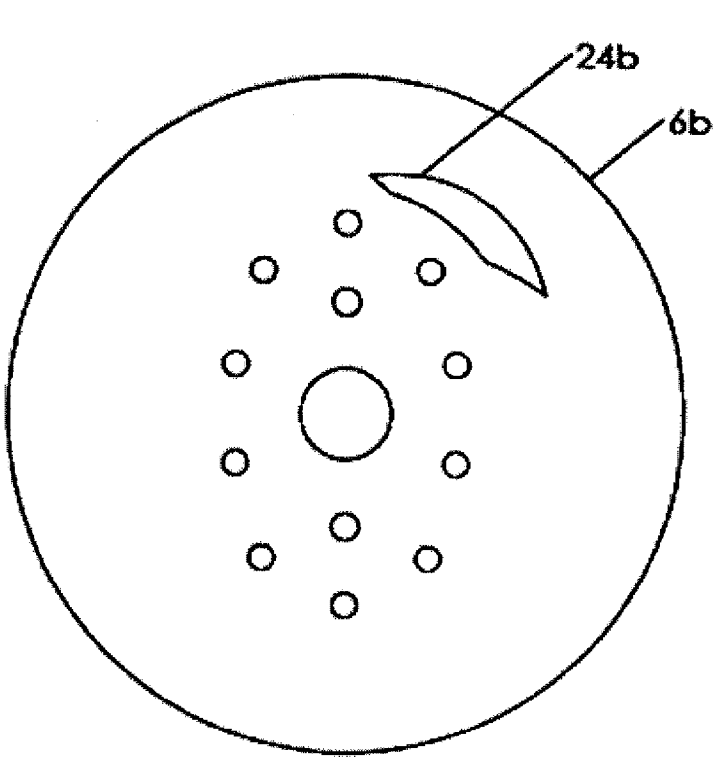
FIGURE 5b
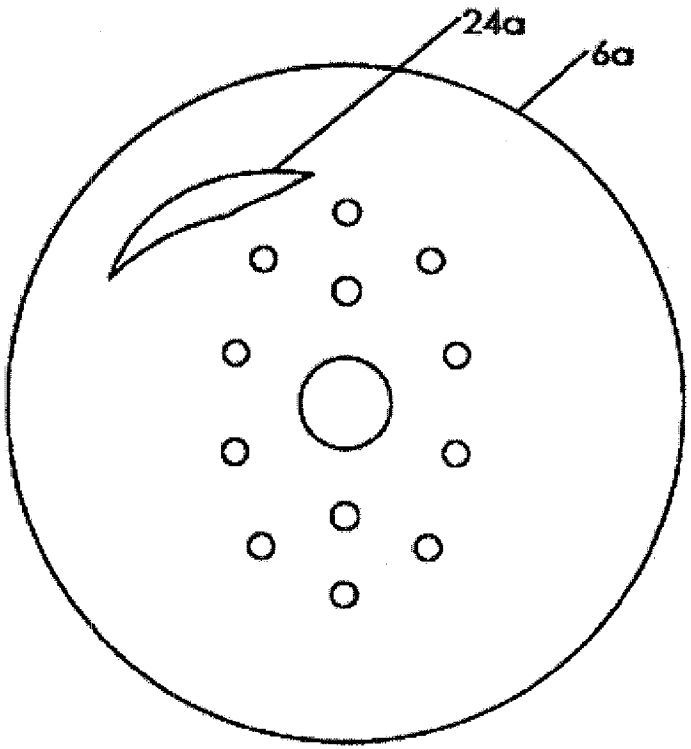
FIGURE 5a
FIGURE 5

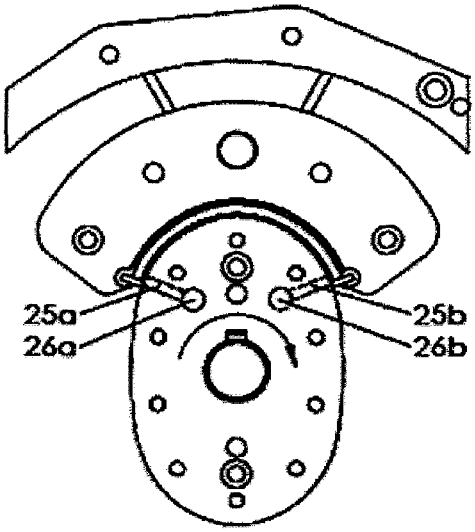
CRANK ANGLE = -180°
FIGURE 7a
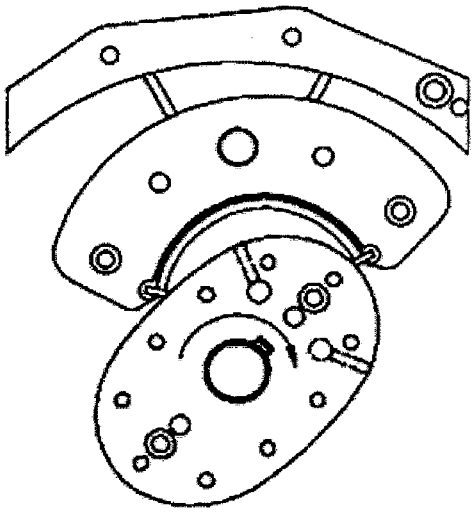
CRANK ANGLE = -135°
FIGURE 7b
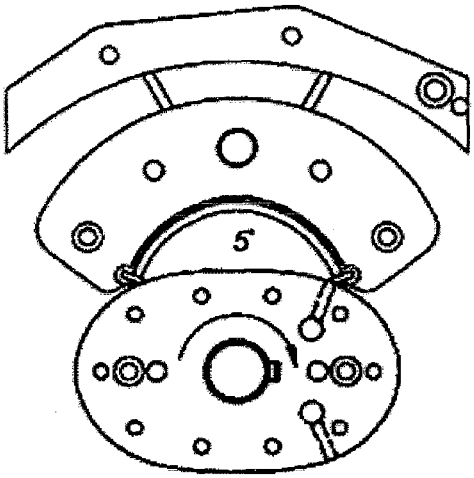
CRANK ANGLE = -90°
FIGURE 7c
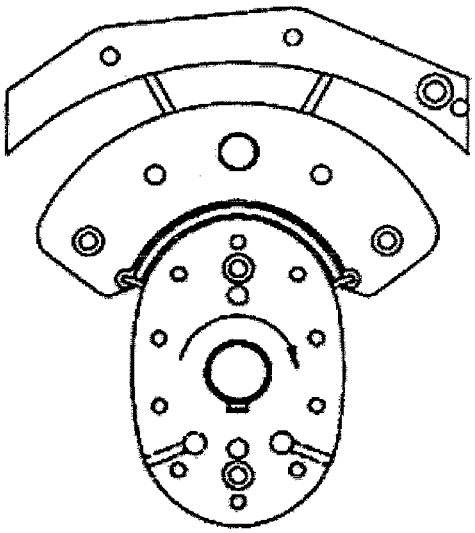
CRANK ANGLE = 0°
FIGURE 7d
FIGURE 7

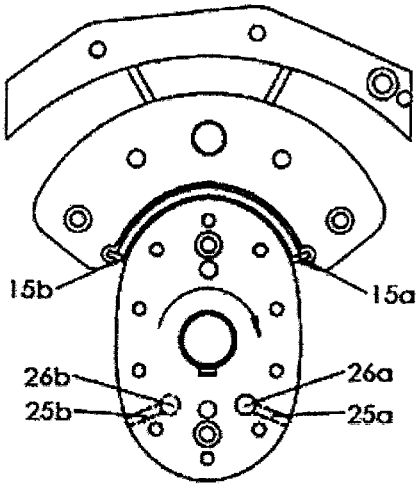
CRANK ANGLE = 0°
FIGURE 8a
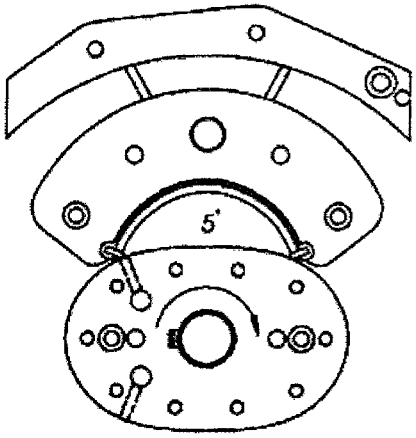
CRANK ANGLE = +90°
FIGURE 8b
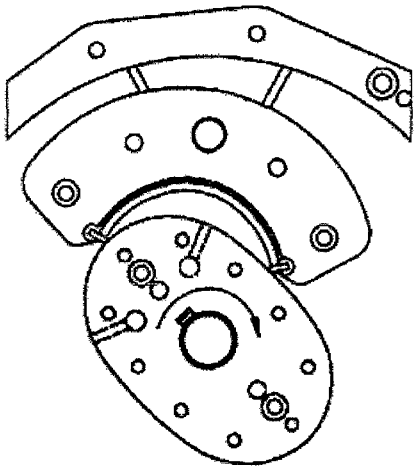
CRANK ANGLE = +135°
FIGURE 8c
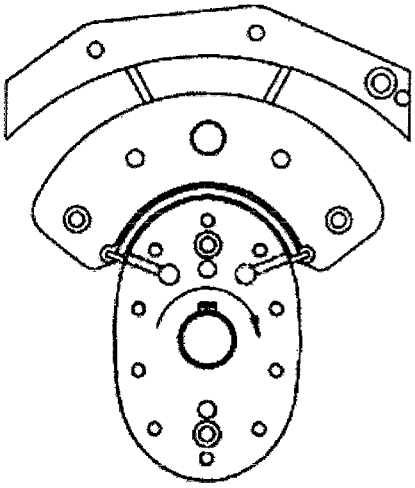
CRANK ANGLE = +180°
FIGURE 8d
FIGURE 8

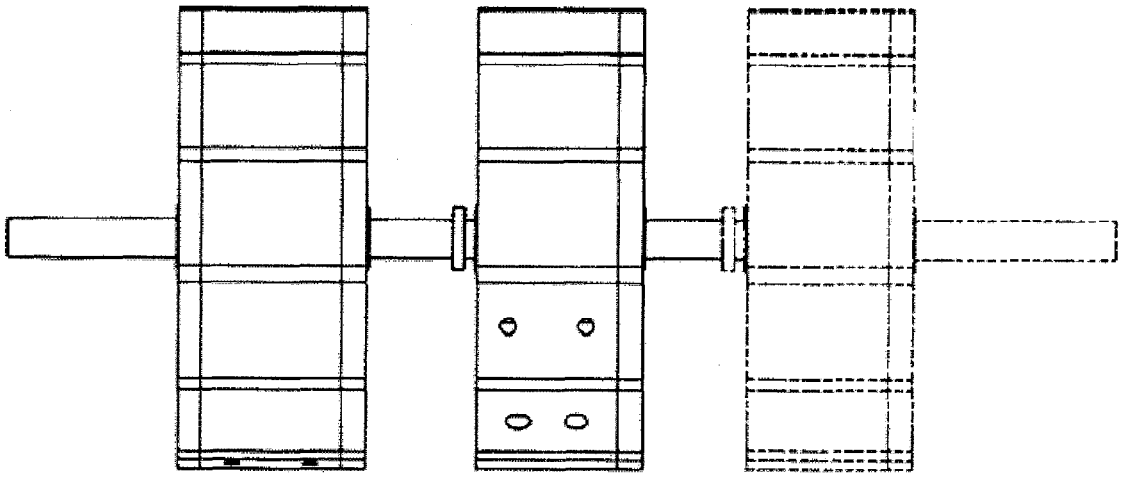
FIGURE 9a
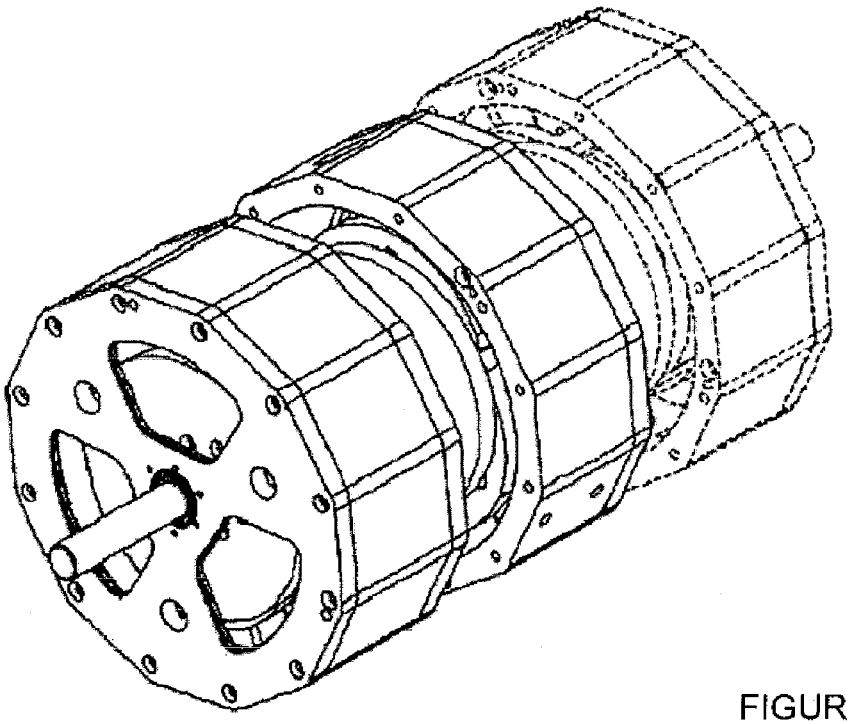
FIGURE 9b
FIGURE 9

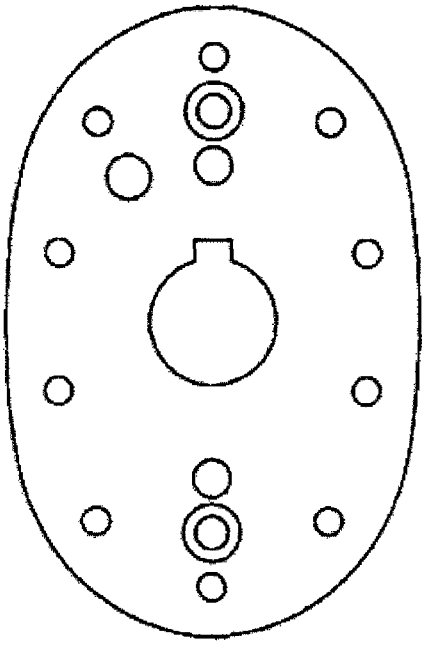
FIGURE 10a
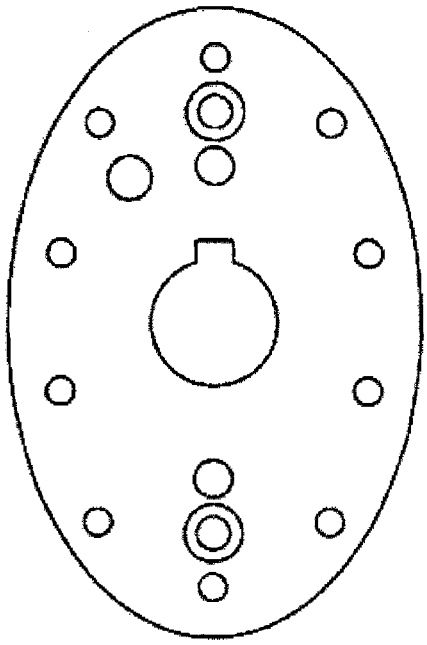
FIGURE 10b
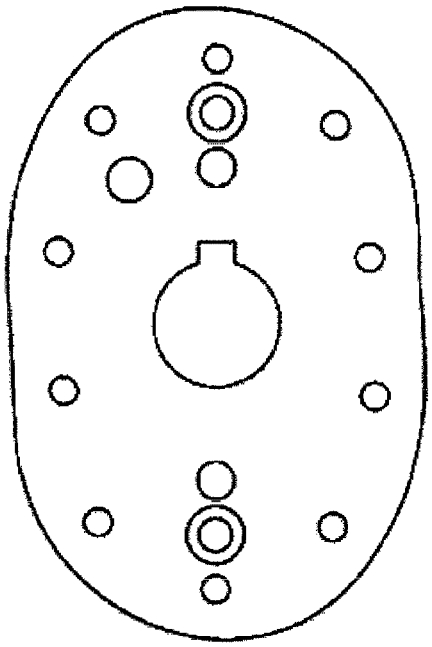
FIGURE 10c
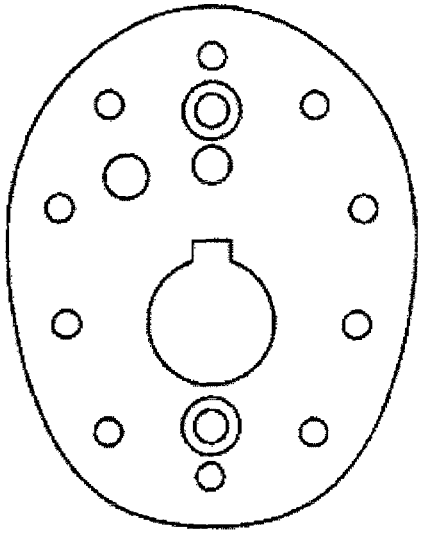
FIGURE 10d
FIGURE 10

DETAIL B

DETAIL A

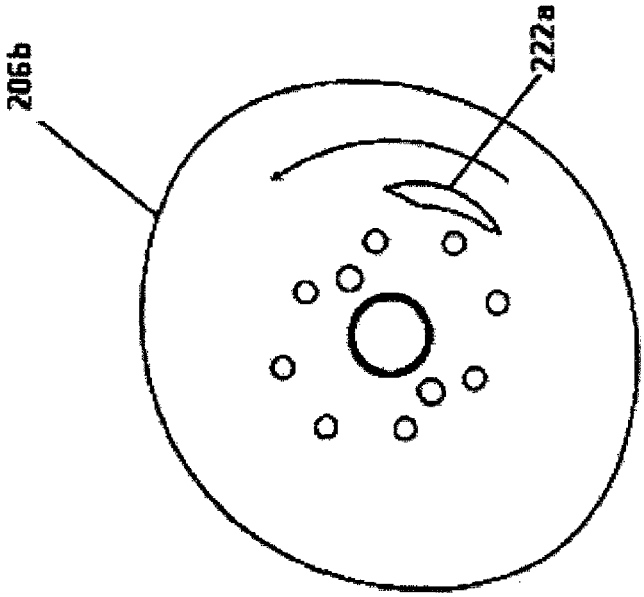
FIGURE 16B
Front Plate with Intake Port
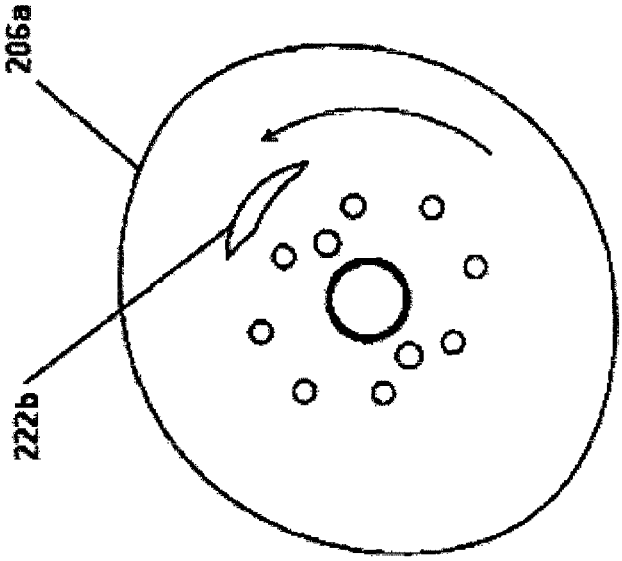
FIGURE 16A
Rear Plate with Exhaust Port
FIGURE 16

START OF INTAKE
CRANK ANGLE = 0 DEG.

CRANK ANGLE -30 DEG.

INTAKE
CRANK ANGLE = ~45 DEG.

START OF COMPRESSION
CRANK ANGLE = 90 DEG.

DURING COMPRESSION
CRANK ANGLE = ~135 DEG.

START OF EXPANSION
CRANK ANGLE = 180 DEG.

DURING EXPANSION
CRANK ANGLE = ~ 225 DEG.

START OF EXHAUST
CRANK ANGLE = 270 DEG.

DURING EXHAUST
CRANK ANGLE = ~315 DEG.

CRANK ANGLE ~330 DEG.

IDAR-ACE INVERSE DISPLACEMENT ASYMMETRIC ROTATING ALTERNATIVE CORE ENGINE

CROSS-REFERENCE TO RELATED APPLICATIONS

This patent application is a continuation of and claims the benefit of priority to International Patent Application No. PCT/US13/30649, filed Mar. 13, 2013, which in turn claims the benefit of priority to U.S. Provisional Patent Application Ser. No. 61/697,481, filed Sep. 6, 2012, and U.S. Provisional Patent Application Ser. No. 61/610,781, filed Mar. 14, 2012. Each of the aforementioned patent applications is incorporated by reference herein in its entirety for any purpose whatsoever.

BACKGROUND

U.S. Pat. No. 6,758,188, entitled "Continuous Torque Inverse Displacement Asymmetric Rotary Engine", the disclosure of which is incorporated herein by reference in its entirety, discloses an Inverse Displacement Asymmetric Rotary (IDAR) engine. The engine includes an inner chamber wall, an outer chamber wall, and a movable contour. U.S. patent application Ser. No. 12/732,160, filed Mar. 25, 2010, which is also incorporated by reference herein in its entirety, presents improved embodiments vis-à-vis the embodiments of U.S. Pat. No. 6,758,188. The present disclosure provides significant improvements over these embodiments, as described herein.

SUMMARY

The disclosed embodiments improve upon the common reciprocating piston engine and rotary engine. Improvements over such common engines include at least:

A higher power density;

A flexible working volume that enables high Atkinson Ratio cycles;

A two-dimensional design that enables practical use of low wear materials;

Two, three or more times as many power strokes per revolution;

An increased mechanical transfer efficiency;

Reduced engine case vibrations; and

Reduced number of parts.

The disclosed embodiments describe a machine used to combust fuel-air mixtures thereby converting chemical energy to rotational kinetic energy. An important feature of the disclosed embodiments is a formation of a working volume by the interaction of a convex surface of a non-round, symmetric or asymmetric rotating cylinder or "island", a reciprocating concave part or "contour," and front and rear side plates.

Thus, in one embodiment, the disclosure provides an engine or pump that includes a rotatable shaft defining a central axis A, the shaft having a first end and a second end. The shaft can have an elongate first island disposed thereon. The first island can have a body with a volume generally defined between front and rear surfaces that are spaced apart along the rotatable shaft. The front and rear surfaces can lie in a plane parallel to a radial axis R. The front and rear surfaces can have a rounded, non-circular shape. The perimeters of the front and rear surfaces can define a curved perimeter surface therebetween. The engine or pump can further include a front side plate disposed adjacent to the front surface of the first island, and a rear side plate disposed adjacent to the rear surface of the first island. The engine or pump can still further include a first contour assembly disposed between the front side plate and the rear side plate. The first contour assembly is defined by a pair of opposed outwardly facing arcuately shaped front and rear surfaces that are connected by a concave inwardly facing surface. The concave inwardly facing surface of the contour assembly faces the curved perimeter surface of the first island. The concave inwardly facing surface and the curved perimeter surface of the island and the front side plate and rear side plate cooperate to form a working volume. The rotatable shaft and first island, or at least the first island are preferably configured to rotate with respect to the first contour assembly.

If desired, the contour assembly can define an opening therein for receiving a spark plug. The first contour assembly can be coupled to a stationary housing. The first contour assembly can be mounted to a stationary wrist pin, such that the first contour assembly oscillates about the wrist pin as the first island and rotatable shaft rotate about the central axis A. The wrist pin is preferably generally parallel to the central axis A. The contour can include a first apex point disposed proximate to a first end of the concave inwardly facing surface of the contour assembly and a second apex point disposed proximate to a second end of the concave inwardly facing surface of the contour assembly. The apex points are preferably disposed in a gap defined between the concave inwardly facing surface of the contour assembly and the curved perimeter surface of the first island. The apex points help to define the working volume. If desired, the apex points can be disposed within recesses defined in the contour assembly. The contour assembly can further include at least one preloading spring disposed proximate to each of the apex points, the at least one preloading spring can be adapted to urge the apex points against the first island.

The gap between the contour assembly and first island that is covered by the apex seals can be less than about 0.10 inches, less than about 0.010 inches, less than about 0.0010 inches, less than about 0.00010 inches, or less than about 0.000010 inches, as desired. The contour can include a first corner seal disposed proximate to the front face of the contour assembly and a second corner seal disposed proximate to the rear face of the contour assembly, the corner seals being disposed in a gap defined between the front and rear faces of the contour assembly and the front and rear side plates, the corner seals helping to define the working volume.

In some implementations, the corner seals can be disposed within recesses defined in the front and rear faces of the contour assembly. The contour assembly can further include corner seal preloading springs disposed proximate to each of the corner seals. The corner seal preloading springs can be adapted to urge the corner seals against the front and rear side plates. The contour assembly can further include a plurality of floating side seals embedded in arcuate grooves defined in the pair of opposed outwardly facing arcuately shaped front and rear surfaces of the contour assembly. The arcuate grooves can be generally coincident with the arcuate extent of the concave inner surface, and intersect with the grooves configured to receive the apex seals. Each of the side seals can sit on top of at least one preloading springs for maintaining stability and orientation of the side seals in the arcuate grooves. Preferably, the corner seals and apex points substantially coincide to help define the working volume. In various implementations, the front and rear side plates can rotate with the rotatable shaft and the island.

In accordance with further implementations, the front and rear side plates can have a center of rotation that substantially matches a geometric center of the front and rear side plates. Alternatively, the front and rear side plates can have a center of rotation that do not substantially match a geometric center of the front and rear side plates. If desired, the engine or pump can further include a front thrust bearing disposed proximate to the front plate and a rear thrust bearing disposed proximate to the rear plate to maintain the first island and side plates at a substantially fixed axial location. In various embodiments, the island can be generally elliptical, generally oval, or generally dumbbell-shaped, among other possible shapes.

If desired, at least one of the front and rear side plates can include ports defined therein for directing working fluids passing through the device. If desired, the first island can include at least one port defined therein for directing working fluids passing through the device. The at least one port can be formed through the curved perimeter surface of the first island. The at least one port can include a first portion that is generally parallel to the radial axis R and a second portion in fluid communication with the first portion that is generally parallel to the central axis A. The second portion of the at least one port can be configured to align with a port defined in at least one of the front and rear side plates.

In some implementations, at least two ports can be formed through the curved perimeter surface of the first island. The at least two ports can include a first port and a second port that are displaced from each other about the curved perimeter surface of the first island along a circumferential axis C that is orthogonal to the central axis A and the radial axis R. The first port can be configured to function as an intake port to direct working fluid into the working volume, and the second port can be configured to function as an exhaust port to direct working fluid out of the working volume. In some implementations, at least one port can include a valve for controlling the flow of fluid therethrough. The valve can be passively or actively actuated.

In further accordance with the disclosure, the engine or pump can further include a second contour assembly disposed between the front side plate and the rear side plate. The second contour assembly can be defined by a pair of opposed outwardly facing arcuately shaped front and rear surfaces that are connected by a concave inwardly facing surface. The concave inwardly facing surface of the second contour assembly can face the curved perimeter surface of the first island. The concave inwardly facing surface and the curved perimeter surface of the first island and the front side plate and rear side plate can cooperate to form a second working volume. The rotatable shaft and first island are preferably configured to rotate with respect to the second contour assembly.

The second contour assembly can be angularly displaced from the first contour assembly about the central axis along a circumferential axis by a first angular increment. For example, the first angular increment can be about 180 degrees, about 120 degrees or about 90 degrees.

In a further implementation, the engine or pump can further include a third contour assembly disposed between the front side plate and the rear side plate. The third contour assembly can be defined by a pair of opposed outwardly facing arcuately shaped front and rear surfaces that are connected by a concave inwardly facing surface. The concave inwardly facing surface of the third contour assembly can face the curved perimeter surface of the first island. The concave inwardly facing surface and the curved perimeter surface of the first island and the front side plate and rear side plate can cooperate to form a third working volume. The rotatable shaft and first island can be configured to rotate with respect to the third contour assembly.

In some implementations, the first, second and third contour assemblies can be angularly displaced from each other about the central axis along a circumferential axis by a second angular increment. The second angular increment can be about 120 degrees or about 90 degrees.

In further implementations, the engine or pump can further include a fourth contour assembly disposed between the front side plate and the rear side plate. The fourth contour assembly can be defined by a pair of opposed outwardly facing arcuately shaped front and rear surfaces that are connected by a concave inwardly facing surface. The concave inwardly facing surface of the fourth contour assembly can face the curved perimeter surface of the first island. The concave inwardly facing surface and the curved perimeter surface of the first island and the front side plate and rear side plate can cooperate to form a fourth working volume. The rotatable shaft and first island can be configured to rotate with respect to the fourth contour assembly.

In further implementations, the first, second, third and fourth contour assemblies can be angularly displaced from each other about the central axis along a circumferential axis by a third angular increment. For example, the fourth angular increment can be about 90 degrees. In various implementations, the engine or pump can further include a housing for containing at least a portion of the rotatable shaft, the first island, and the front and back side plates.

In some implementations, the rotatable shaft can include a second elongate island disposed thereon. The second island is preferably axially displaced along the shaft from the first island, the second island has a body with a volume generally defined between front and rear surfaces that are spaced apart along the rotatable shaft. The front and rear surfaces preferably lie in a plane parallel to the radial axis R. The front and rear surfaces preferably have a rounded, non-circular shape. The perimeters of the front and rear surfaces define a second curved perimeter surface therebetween. The engine or pump can further include a second front side plate disposed adjacent to the front surface of the second island, a second rear side plate disposed adjacent to the rear surface of the second island, and a second contour assembly disposed between the second front side plate and the second rear side plate. The second contour assembly can be defined by a pair of opposed outwardly facing arcuately shaped front and rear surfaces that are connected by a second concave inwardly facing surface. The second concave inwardly facing surface of the contour assembly can face the second curved perimeter surface of the second island. The second concave inwardly facing surface and the second curved perimeter surface of the second island and the second front side plate and second rear side plate can cooperate to form a second working volume. The rotatable shaft and second island are preferably configured to rotate with respect to the second contour assembly. If desired, at least one of the second front or rear side plate can be integral with the front or rear side plate that is associated with the first island.

In some implementations, the engine or pump can further include at least one cam follower operably coupled with the first contour assembly. The at least one cam follower can be adapted to roll along an edge surface of at least one of the front side plate and rear side plate. The at least one cam follower can be mounted on a lever arm that is coupled with the first contour assembly.

In accordance with further aspects, the engine or pump device can be used as a pump or compressor. For example, the device can be an air conditioning compressor configured to compress refrigerant. In another embodiment, the engine or pump can be a steam driven engine, or an engine driven by compressed air. Such an engine can be connected to an input shaft of a device such as a generator or pump, or other device, as desired.

It is to be understood that both the foregoing general description and the following detailed description are exemplary and are intended to provide further explanation of the embodiments disclosed herein.

The accompanying drawings, which are incorporated in and constitute part of this specification, are included to illustrate and provide a further understanding of the methods and systems of the disclosure. Together with the description, the drawings serve to explain the principles of the disclosed embodiments.

BRIEF DESCRIPTION OF DRAWINGS

Accompanying the description are plural images illustrating the disclosed embodiments, which represent non-limiting examples and in which:

FIGS. 5A-5B present illustrative side plate porting for a C.E. (Combustion Engine) in accordance with the embodiment of FIG. 1;

FIGS. 7A-7D illustrate various operations of a C.E./pump in accordance with the embodiment of FIG. 1;

FIGS. 8A-8D illustrate still further operations of a C.E./pump in accordance with the embodiment of FIG. 1;

FIGS. 9A-9B illustrate a side view of a first example of an engine using three spaced apart islands, wherein successive islands are spaced apart from each other 40 degrees;

FIGS. 10A-10D illustrate a variety of different islands that can be used for the island of the embodiment of FIG. 1;

FIGS. 16A-16B illustrate porting for a C.E. (Combustion Engine)/pump for the embodiment of FIG. 11;

DETAILED DESCRIPTION

Figure 1:
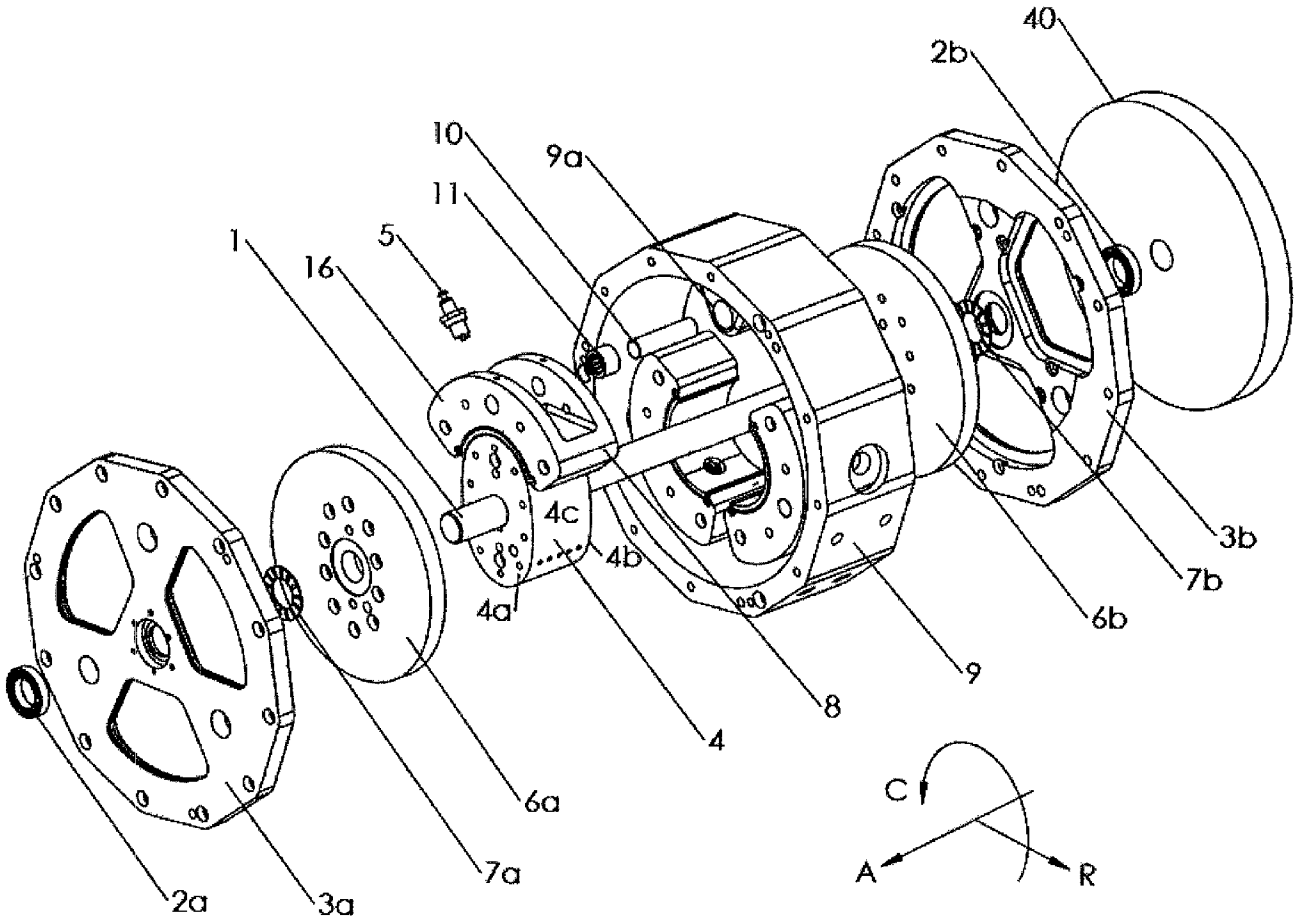
FIG. 1 illustrates an exploded, isometric view of a first embodiment in accordance with the present disclosure.

Referring to FIG. 1, components are illustrated which form embodiments of the disclosure. In addition, a coordinate system is illustrated which will be utilized for discussing the disclosed embodiments. This coordinate system is a cylindrical, three dimensional system, including axial (A), radial (R) and circumferential (C) axes. As illustrated in FIG. 1, a rotatable shaft 1 is held by a pair of front 2*a* and rear 2*b* radial frictionless, oil film or plain bearings. The bearings are supported by a pair of front 3*a* and rear 3*b* stationary case end plates.

The rotatable shaft 1 is affixed to, or has integrated in it, a cylindrical-like shaped structure 4 or "island". The Island 4, is sufficiently thick having two parallel flat surfaces 4*a* and 4*b* and a perimeter surface 4*c* which is curved and may be any suitable shape, such as elliptical, oval and the like, as discussed in further detail below.

As illustrated in FIG. 1, mechanically fastened to or integrated in front 4*a* and rear 4*b* flat ends of the island 4 are a pair of generally circular front 6*a* and rear 6*b* side plates having a generally uniform thickness, such that a substantially gas-tight or fully gas tight seal is formed between the island and the end plates, as well as between the contour portions 8 and the end plates such that a substantially or fully gas-tight chamber can be defined by an outer surface of the island 4, the inner faces of the side plates 6, and an inner face of the contour assembly(ies) 8. The side plates 6*a*, 6*b* rotate with the shaft 1 as depicted but may or may not have a center of rotation that matches a geometric center of the side plates 6*a*, 6*b* and island 4 combination. Non-coincident rotating and geometric centers can produce the desirable effect of asymmetric working volume dynamic changes. A pair of front 7*a* and rear 7*b* thrust bearings are used to keep the island-side plate combination at a fixed axial location.

A concave-shaped part or "contour assembly" 8 is depicted in the figures, having a pair of opposed outwardly facing arcuate surfaces that cooperate with and are connected by a concave inwardly facing surface that faces the island 4. The contour assembly 8 also can have an opening (if desired) for receiving a spark plug 5 or other similar device. The contour assembly 8 is inserted between plates 6*a* and 6*b* such that the inner concave face is facing the island 4 forming a working volume 5' (see FIG. 2) there between. A pair of first 15*a* and second 15*b* apex points (FIG. 2), contact the convex surface of the island 4 and the parallel surfaces of the side plates 6*a*, 6*b* to help define working volume 5' that can act as a combustion chamber when the disclosed embodiments act as an internal combustion engine, rather than a pump or compressor (in which case the engine will be driven by driving pressurized fluid into the working volume, e.g., via a port in a location generally coinciding with the spark plug port), as alternatively discussed herein. The thickness or depth of the island 4 and corresponding parts of the engine (e.g., contours 8 and housing 9) can be increased or decreased to correspondingly provide an engine having a relatively larger or smaller working volume 5'. The size of the working volume can additionally or alternatively be scaled by increasing or decreasing the diameter of the engine and altering the curvature of the inner arcuate surfaces of the contours 8.

Figure 26:
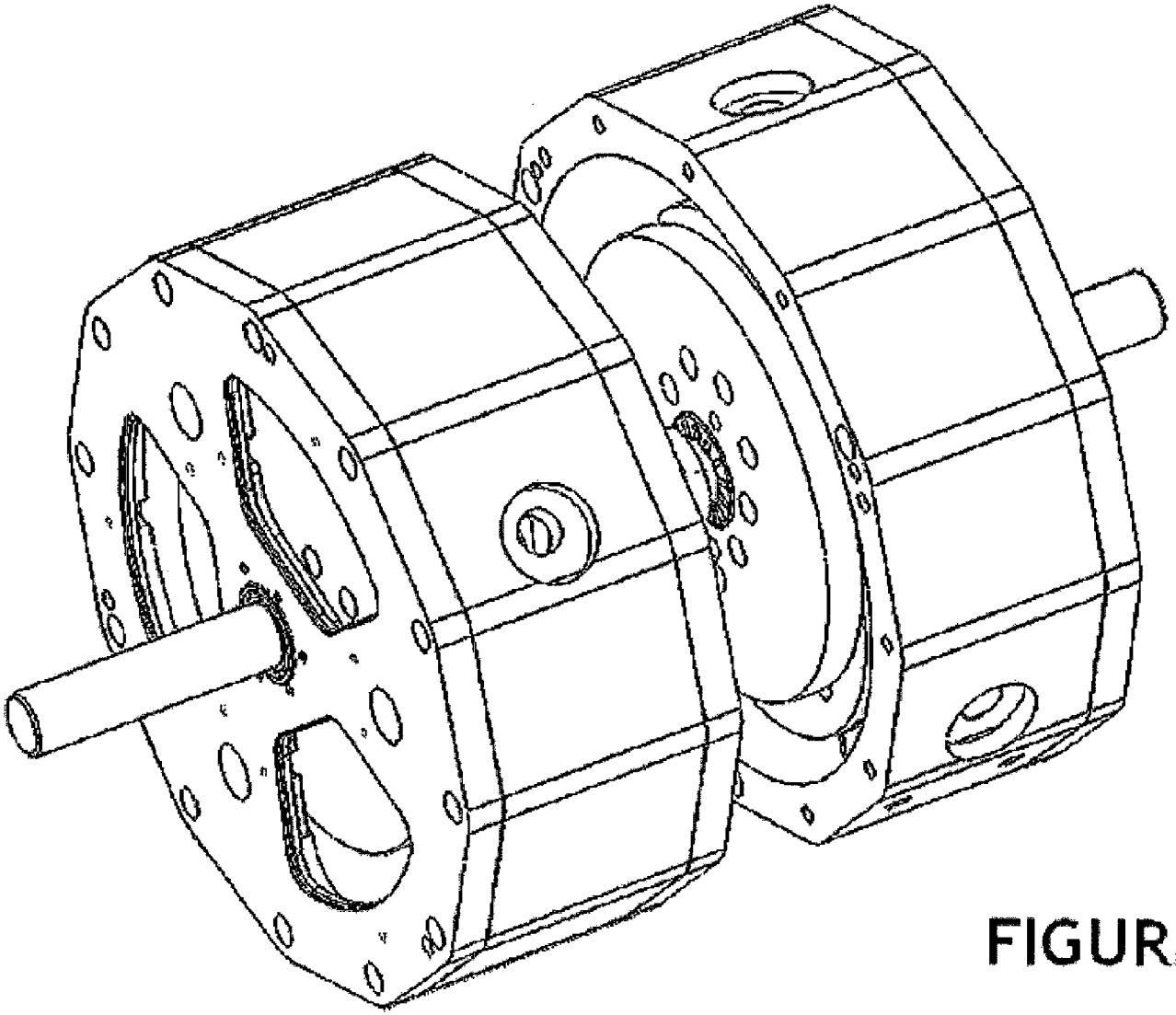
FIG. 26 illustrates an example of a two island engine wherein the islands are spaced apart by sixty degrees.

Outer housing 9 has at least one or up to N appendages or anchor points 9*a-n*, which point inwardly toward the island 4 separated from each other by about 120 degrees (in the case that N=3) of circumferential extent. This exemplary embodiment shows a quantity of three anchor points (9*a*, 9*b* and 9*c* of FIG. 2). Outer housing 9, is attached to both stationary case end plates 3*a* and 3*b*. In an alternative embodiment, housing 9 can be made in two castings or a single casting and an endplate that use a single seal, rather than having a cylindrical housing with two end plates. For purposes of illustration only, consecutive islands and housings can be stacked serially and be discrete as illustrated in FIGS. 9(*a*)-9(*b*) and in FIG. 26. It should be noted that not all details of the engine are present in the aforementioned illustrations. If desired, the housings can be combined into the same structural unit wherein the housings are integrated (e.g., into the same casting). For example, two adjacent cylindrical cavities, each containing an island, can be formed integrally having a cover portion covering each end of the casting to complete two cylindrical cavities.

With further reference to the Figures, wrist pins 10, are disposed in a double shear mode that enables high rigidity in the structure. Side plates 6*a*, 6*b* rotate inside of outer housing 9. Lubricant (e.g., ordinary or synthetic motor oil) can be disposed in the lower portion of outer housing 9. As side plates 6*a*, 6*b* rotate, they pass through the lubricant and help distribute it over the parts of the engine inside of housing 9. If desired, end plates 6*a*, 6*b* can be provided with an irregular or textured (e.g., embossed/grooved) surface to facilitate the uptake and distribution of lubricant.

Figure 2:
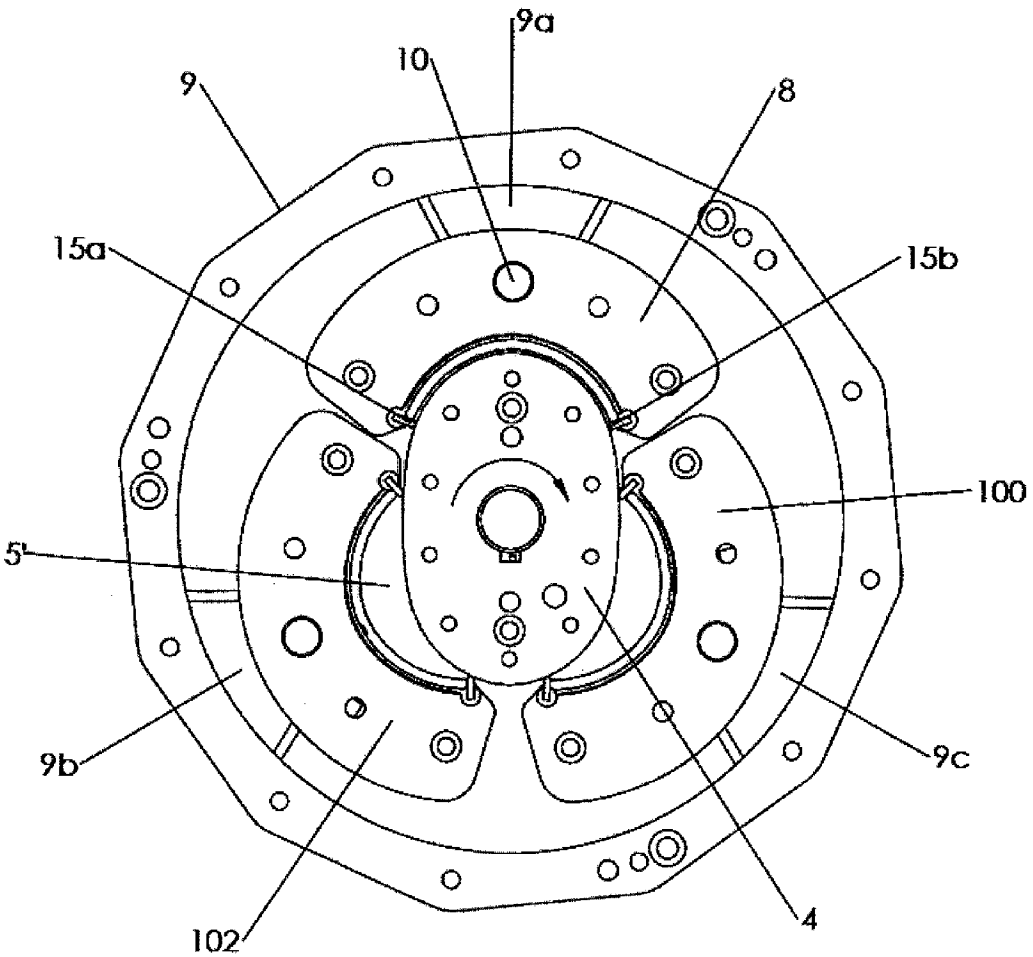
FIG. 2 illustrates mechanical detail of a portion of the embodiment of FIG. 1.
Figure 3:
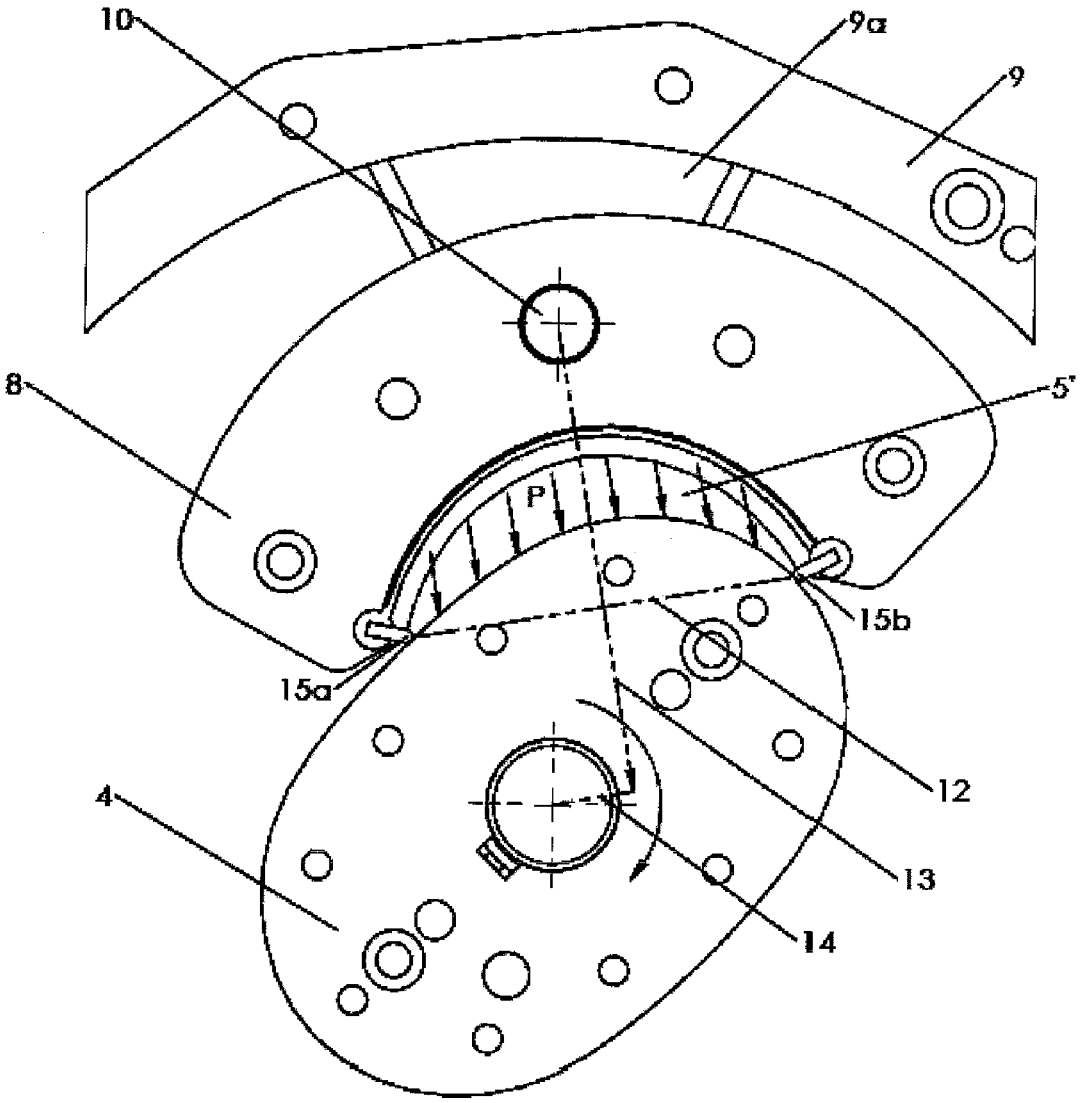
FIG. 3 illustrates mechanical motion of a portion of the embodiment of FIG. 1.

The parts as arranged in FIG. 3 create the motion of the contour assembly 8. Specifically, the contour assembly 8 is connected to an appendage 9*a* on outer housing 9 by use of wrist pin 10. While the planform area of housing 9 is generally round in shape (see, e.g., FIG. 2), any suitable shape can be used. The connection via pin 10 allows the contour assembly 8 to pivot or oscillate in the plane as viewed in FIG. 3 about the center of 10. Alternatively, wrist pin 10 may also contain one or more frictionless bearings 11 shown in FIG. 1. It will also be appreciated by those of skill in the art that while three contours are presented in the first illustrated embodiment, any suitable number of circumferentially spaced contours riding on pivots (e.g., wrist pins 10) can be used, such as one, two, four, five, or more contours.

To describe the motion of contour assembly 8 two conventions are made herein: 1.) The apex seal 15*a*, which rides over the outer surface of the island 4*c* that, until immediately before reaching the seal, is not within a combustion chamber, is called the "leading" seal. 2.) the apex seal 15*b*, which rides over island surface that, until immediately before reaching the seal, is only inside a combustion chamber is called the "trailing" seal. This is the case in FIG. 3 where the island 4, is shown rotating in the clockwise direction.

In the case where the island 4 is rotating clockwise, should the contour require to pivot in the clockwise direction, the leading apex seal 15*a*, would be subject to a contact force and hence force a clockwise rotation. Should the contour require a counter clockwise rotation, the trailing apex seal 15*b*, would be subject to contact force.

The shape of the outer surface 4*c* of the island 4 and the geometry of contour assembly 8, together with the pivot location 10, minimize the free play between the motions of increasing and decreasing the working volume 5'. The curvature of the surface of the island 4 can be a continuous geometric shape and follow the profile of a known shape (e.g., ellipse) or may deviate from such a uniform shape along its circumferential path, such as by having one or more irregularities (e.g., concavities or convexities) that fall outside the uniform shape, such as those illustrated in FIGS. 10(*a*)-10(*d*). The contour of the external surface of the island 4 is preferably adapted and configured to maintain a substantially uniform gap between the locations of the contours having apex seals to permit a relatively small amount of seal travel to extend seal life and engine durability. For example, the gap covered by the apex seals can be less than about 0.10 inches, less than about 0.010 inches, less than about 0.0010 inches, less than about 0.00010 inches, and less than about 0.000010 inches, in any desired increment of about 0.0000010 inches. The preferred shape of the island and the gap is affected by a variety of geometric factors including the size, shape and number of contours, (e.g., 1, 2, 3, 4, 5 or more contours), the size of the engine, and the like.

Figure 4:
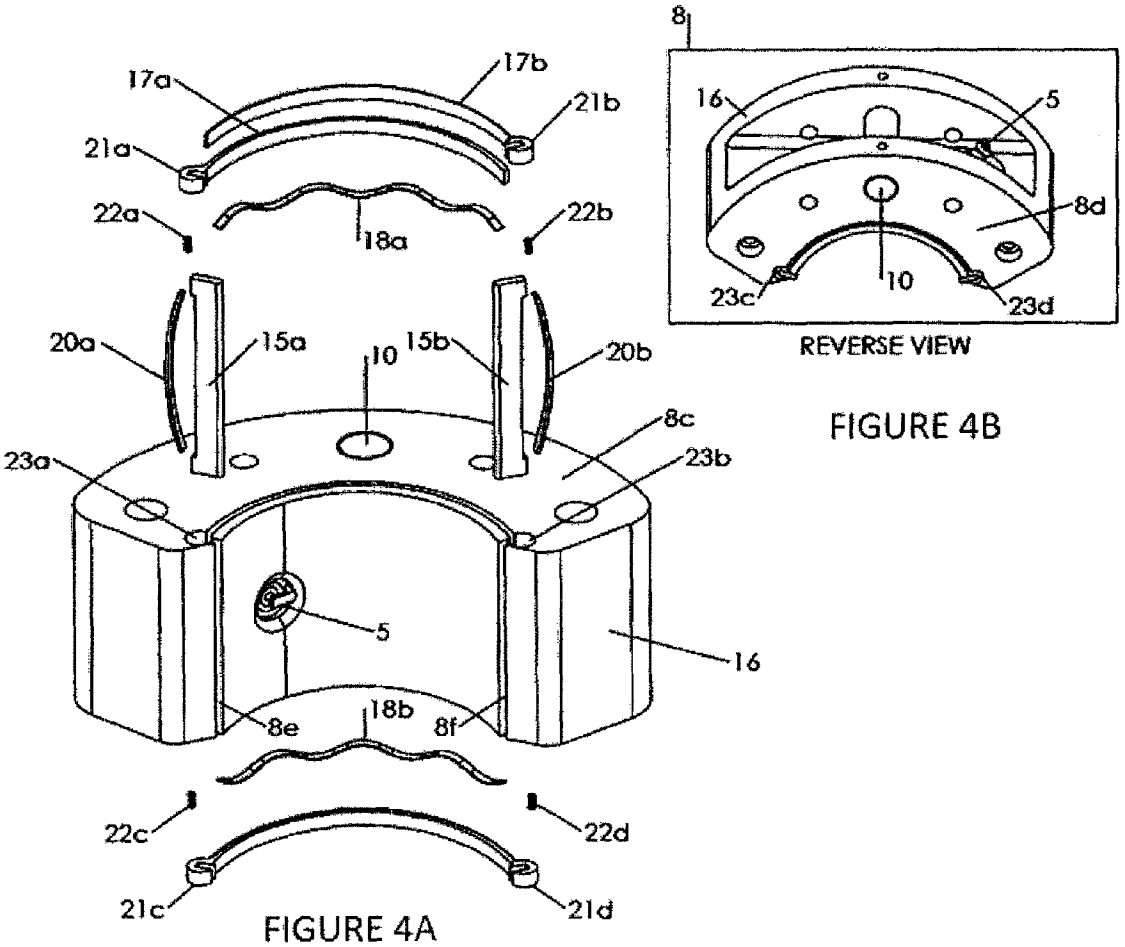
FIGS. 4A-4B illustrate aspects of a contour portion of the embodiment of FIG. 1.

The contour assembly 8 as shown in FIG. 4, includes a main body 16 and additional parts (e.g., springs, apex seals, other seals and the like), discussed below, to prevent leakage of the working fluids (in the case of an engine) or the fluids being worked (in the case of a pump or compressor) from the working volume. The assembly can include a spark plug 5 as illustrated in FIG. 4 and described in the related text, below in the case of an internal combustion engine.

The main body 16 of contour assembly 8 is preferably narrower than the thickness of the island 4 and can be made of materials not conducive to wear. For example, main body 16 can be made from aluminum or other light weight materials; as well it could be made from cast iron or forged steel. Moreover, ceramic coatings or inserts can also be applied disposed on the inner concave face of the contour assembly for improved thermal and combustion behavior. A gap, which is to be sealed, is defined between the main body 16 of the contour assembly 8 (FIG. 1) and the adjacent side plates 6*a*, 6*b*. To bridge this gap and keep gases/fluids in the working volume 5', as illustrated, floating side seals 17*a*, 17*b* can be provided (FIG. 4) that are embedded in arcuate grooves formed in the outer arcuate surfaces of the main body 16. As illustrated, the arcuate grooves are generally coincident with the arcuate extent of the concave inner surface of the main body 16, and can intersect with grooves 23*a*, 23*b* that are adapted and configured to receive the apex seals 15*a*, 15*b*. Other embodiments can employ additional channels to further reduce leakage, and/or single-piece floating side seals in which 17*a* and 17*b* are merged into one part.

To prevent gases from leaking out via the apex points (FIG. 3) floating apex seals 15*a*, 15*b* of FIG. 4 are inserted into transverse, axially extending, matching channels 8*e* and 8*f* in the contour 8. The apex seals 15*a*, 15*b* contact the surface 4*c* of island 4 as shown in FIG. 3. The seals 15*a/b* and matching channels 8*e/f* are dimensioned to minimize leakage over the top and around 15*a/b* but still allow some movement of the floating seal as discussed above. Channels 8*e, f*, as illustrated, are oriented generally orthogonally with respect to the arcuate grooves that receive side seals 17*a, b* in opposing flat faces 8*c*, 8*d* of the contour 8. The side seals 17*a*, 17*b* sit atop preloading springs 18*a*, 18*b* which have a wavy contour to maintain stability and orientation of the seals 17*a,b* in the arcuate grooves. As is further evident from the inset of FIG. 4 illustrating the "reverse view", contour portion 8 further includes a hollowed portion on its outwardly facing arcuate surface that is defined by two radially extending and inwardly facing walls having an outer arcuate edge that joins a generally straight inner edge. The generally straight inner edges of the inwardly facing walls help to define a generally planar surface that faces radially outwardly, in which the spark plug 5 is received.

Preloading springs 20*a*, 20*b* (FIG. 4) maintain a nominal seal contact force of the apex seals 15*a*, 15*b*. For enhancing seal contact force, internal gas pressure "P" (FIG. 3) within working volume 5' creates an unbalanced load on the seals, thus increasing the seal contact force at 15*a* and 15*b* proportionally to the internal pressure of the working volume 5'. Preloading springs, 20*a* and 20*b* furthermore assist in correcting for differences in the motion and wear at the contact points of 15*a*, 15*b*. To further enhance sealing, corner seals 21*a*, 21*b*, 21*c* and 21*d* with one each respectively preload springs 22*a*, 22*b*, 22*c* and 22*d* installed inwardly of the corner seals are installed in matching pockets 23*a*, 23*b*, 23*c* and 23*d* formed adjacent each end of channels 8*e*, 8*f*.

In a typical application, one to multiple copies of the contour assembly 8 shown in FIG. 4 may be used. For purposes of illustration only, as illustrated in FIG. 2, the depicted embodiment uses three of the same sub assemblies 100, 102, each including contour assemblies and related parts identified in FIG. 4. The sub assemblies 100, 102 are rotationally separated by N/360° degrees around the island 4, where N is the number of subassemblies. In this case it is 120°.

In the case when the disclosed embodiment is used as an internal combustion engine, an ignition spark plug 5 is provided, and is preferably, but not necessarily, located as centrally as practicable in the contour 8 as shown in FIG. 4. A high voltage electrical spark is transferred to the center electrode of the sparkplug through a high voltage wire, spring or other mechanism not shown. The high voltage electrical pulse is created in a magneto, electronic ignition coil or other conventional components not shown, and timed to the rotational position of the shaft. It will be appreciated that the subject embodiments can also be used as a pump or compressor as discussed elsewhere herein.

Working gases such as fresh air-fuel mixtures or exhaust are conveyed into and out of the working volume 5' with ports located in the side plates 6*a* and 6*b* or island 4. The ports may include, but are not limited to, those illustrated in FIGS. 5 and 6.

Side plate ports: In the case of side plate porting, side plates 6*a/b* have specially shaped through-openings 24*a*, 24*b*, which as the island 4 and side plates 6*a*, 6*b* assembly rotates, come into view of the working volume 5'. Such openings 24*a/b* were described in U.S. patent application Ser. No. 12/732,160 for an INVERSE DISPLACEMENT ASYMMETRIC ROTARY (IDAR) ENGINE, filed on Mar. 25, 2010 incorporated herein by reference in its entirety (for any purpose whatsoever) in which the contours 8 revolved around the fixed island 4. As indicated, while the island 4 revolves in the embodiment disclosed herein, the covering and exposing ports is still accomplished by the movement of the contour(s) 8. The shapes of the openings 24*a*, 24*b* are optimized to enhance flow timing, seals traversing over ports and minimize parasitic losses.

Figures 6, 6A, 6B:
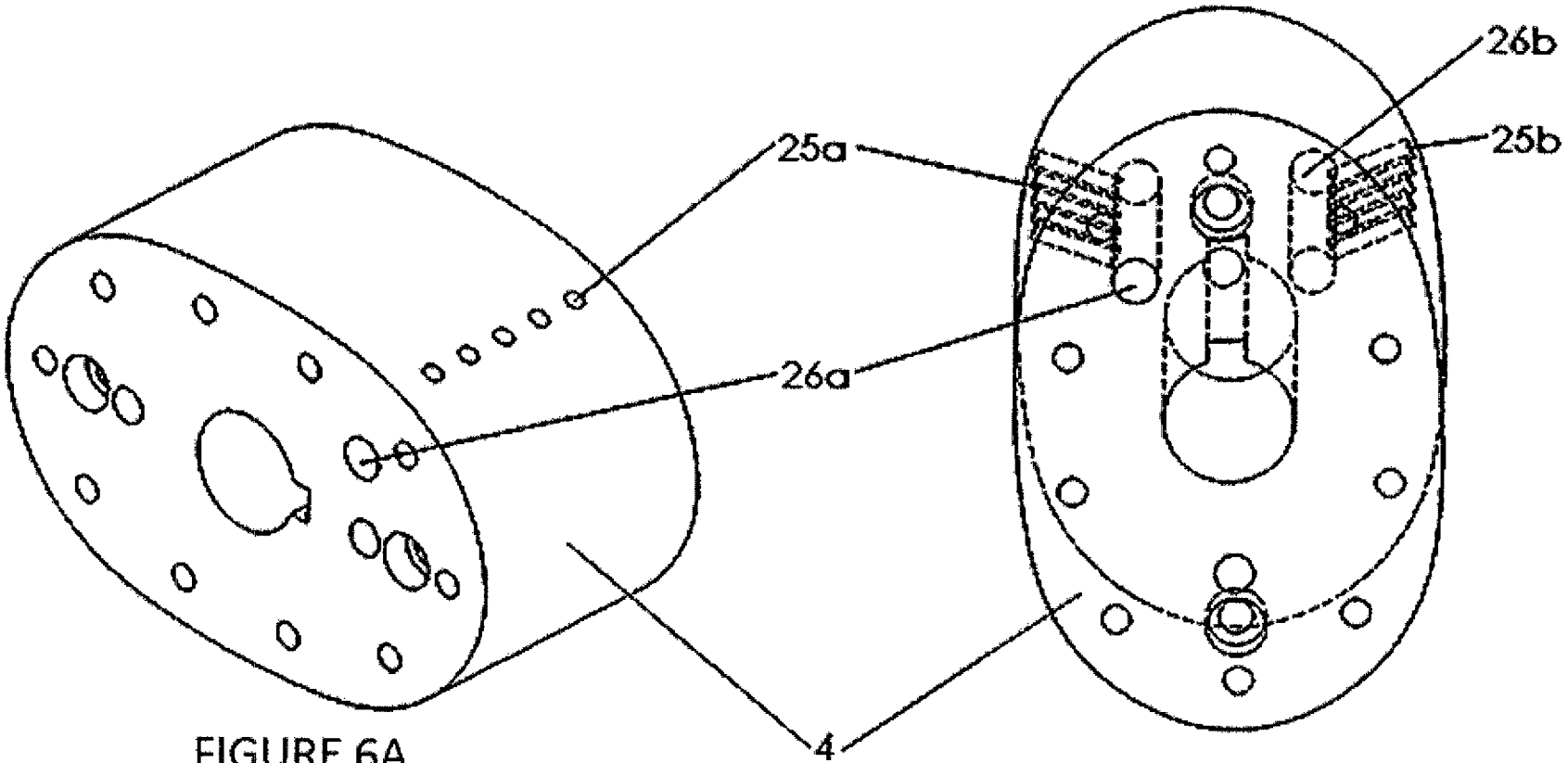
FIGS. 6A-6B present illustrative porting of the island for a C.E. in accordance with the embodiment of FIG. 1.

Island Based Ports:

Alternatively, FIG. 6 shows an embodiment where the working gases enter and or exit through the island 4. Such intake and exhaust ports may have devices that control the back flow of gases (e.g., check valves or active valves). As depicted, intake gases flow through one or more ports 25*a* and exhaust gases flow through one or more ports 25*b* formed at angularly displaced, generally opposing portions of the outer peripheral face of the island 4.

Ports 25*a*, 25*b* begin at the surface 4*c* of the island 4, and extend generally radially inwardly until they intersect and are in fluid communication with corresponding passages 26*a* and 26*b*, which allow gases to enter or exit axially from the rotating parts. As illustrated, passages 26*a*, 26*b* are oriented generally orthogonally with respect to passages 25*a*, 25*b*, and are oriented generally parallel with respect to the shaft 1 of the engine.

As further illustrated in FIG. 6, the central bore of the island can have a slot portion for mating with a corresponding key portion on the crankshaft. In the alternative, the island can be formed integrally with the shaft 1, via techniques such as forging and the like.

In the case of either porting configuration, the island and side plates preferably includes rotary seals (not shown) to interface the intake and exhaust manifolds with the rotating ports. This prevents the gases from mixing with the inner space contained by the engine case 3*a*, 9 and 3*b* and directs gases to the outside of the engine.

When Used as an Internal Combustion (I.C.) Engine

When used to convert chemical energy to rotational kinetic energy, a four stroke cycle is used, and one complete cycle is performed in one shaft revolution. If three contour assemblies 8, 100 and 102 are used as shown in FIG. 2, a total of three complete cycles are performed in one revolution. Flywheel 40 illustrated in FIG. 1 is also added to store rotational energy. This flywheel can be optionally omitted in larger scale designs where the rotating island-sideplate assembly is able to store substantial rotational energy.

For valving, side plates 6*a*, 6*b*, may typically have single port openings respectively 24*a* and 24*b* as shown in FIGS. 5*a/b*. Another embodiment shown in FIG. 6 may have both ports 25*a/b* in the island which are fed by passage ways 26*a/b*. The angular locations of each port with respect to a single common indicia on the shaft 1, and the locations of the contour assemblies 8, determine the function of each port. The angular location=0 degrees will be set at the start of combustion for these discussions. This position is commonly called Top Dead Center (TDC). A negative angle is considered before TDC and a positive is after TDC.

Intake Stroke:

FIGS. 7 and 8 show various points in rotation where the working volume is explained. On or before Crank Angle=−180°, FIG. 7*a*, a port designated as the intake port, for example, Port 25*a*, starts to become exposed in the rotating Island 4 (note arrow for rotation direction) to the working volume 5'. Passage way 26*a* is externally connected to a fresh air source to which a means to inject or induce fuel, such as gasoline, propane or methane gas into such air stream. This allows the combustible mixture of fuel and air to be suctioned into the working volume 5' (FIG. 7*b-c*), which is increasing at the same time.

It will be appreciated by those of skill in the art that any suitable combustible fuel can be used, such as hydrogen, diesel, kerosene, natural gas, ethanol (and other alcohols), and the like. By way of further example, in another aspect, an embodiment of the disclosed engine is attached to an electrical generator for power generation that can use combustible fuels, as well as other types of working fluids having relatively high pressure energy with respect to the environment in which the engine is situated, such as steam, water, compressed air, combustion products, other gases, and the like. For example, a disclosed engine/generator combination could be coupled to a boiler used to generate steam that is heated by combustion or other (e.g., nuclear) power. The energized fluid can cause the engine to rotate, thus driving the generator. As such, embodiments of the disclosed engine can be used in any suitable application where fluid driven turbines are used. Such a combination can also be used to be driven by a pressurized liquid and act as a hydraulic motor, such as in the case of hydroelectric power or could be used in a hydraulic drivetrain for power generation or propulsion purposes.

The island 4 continues to rotate as shown in FIG. 7*c*, Crank Angle=−90°. At this point, intake port 25*a*, which is circumferentially trailing in the direction of motion, is now aligned with the contacting edge of apex seal 15*b*, so as to close the intake port 25*a*. At this point, intake charge compression begins.

Compression Stroke:

As the cycle continues from Crank Angle=−90° to Crank Angle=0°, shown in FIG. 7*d* the fuel-air charge is compressed into a gradually decreasing working volume. Stored rotational energy from a flywheel 40 of FIG. 1 forces the continued rotation of the island 4 and forces contour assembly 8 to constrict the working volume 5'. This compresses the gas mixture. Due to continued relative movement of the island 4 and contour assembly 8, compression continues until a minimum void exists between the island facing surface of the contour assembly 8 and the contour facing surface of the island 4*c*, until the working volume 5' reaches its minimum volume shown in FIG. 7*d*. This is the compression stroke.

Power Stroke:

When the working volume 5' is near or at TDC (FIG. 8*a*), the spark plug 5 is energized from an external high voltage coil and the fuel-air mixture is ignited. All ports remain closed at this time. The rapidly burning, expanding gases begin pushing the contour 8 outward and island 4 clockwise.

Power Stroke Kinematics:

FIG. 3 shows the island Crank Angle=+45 degrees of the power stroke. The force created by gas pressure "P" of FIG. 3, representing in this case that from burning gases, is constrained by wrist pin 10, and applied to surface 4*c* of the island. The effective area of the gas force is developed by a rectangle formed by chord line 12 between apex seals 15*a/b*, and extruded by the thickness of the island. The total force developed by the working volume on the island is equal to this effective area multiplied by the chamber pressure. The force is driven perpendicular to the effective area, shown as direction 13, and applied to the moment arm line 14 to generate torque and useful rotational power. The power stroke continues until +90° after TDC.

Exhaust Stroke:

After the working volume 5' reaches its maximum at +90° as shown in FIG. 8*b*, exhaust port 25*b* begins to be exposed to the working volume 5' due to relative movement of the island 4 and the contour assembly 8. Positive power transmission ceases. Port 25*b* gradually then fully opens as shown in FIG. 8*c*, and the spent gases are pushed out port 25*b* and into the exhaust system to atmosphere, as the working volume 5' decreases.

Exhausting continues to occur through to the beginning of the intake cycle, at which point ports 25*a*, 25*b* are both within the working volume 5'. At the point when the working volume 5' can get no smaller, the cycle is repeated with the intake stroke as shown in FIG. 7*a* and repeated in the related text.

In similar fashion but +120 degrees out of phase for a three-contour engine, contour assembly 100 is repeating the above 4 stroke cycle using the same ports that were used for assembly 8.

In similar fashion but −120 degrees out of phase for a three-contour engine, contour assembly 102 is repeating the above 4 stroke cycle using the same ports that were used for assembly 8.

The shape of the island 4 can be chosen to modify the variation in working volume over the engine cycle so as to exhibit a power stroke maximum volume which is larger than the intake stroke maximum volume. Additionally, the length and closing point of intake port 24*a* can be modified to simulate a smaller intake stroke volume. When the expansion volume is larger than the intake volume, it is said to be an "Atkinson Cycle". The ratio of the expansion volume over the intake volume is known as Atkinson ratio. Ratios significantly greater than 1.0 can produce higher fuel efficiency combustion engines. Particular geometry details of the invention can be easily modified to boost the Atkinson ratio well over 1.0.

While the geometry of the three contour island is illustrated showing three contours in place, it is also within the scope of the disclosure to provide only one or two contours in the three contour geometry. The three contour geometry is capable of operating as an internal combustion engine with only one contour installed. Thus, the disclosure also provides an engine with a single contour. As such, an internal combustion engine is disclosed having only two moving parts—the island and the contour.

Figure 25:
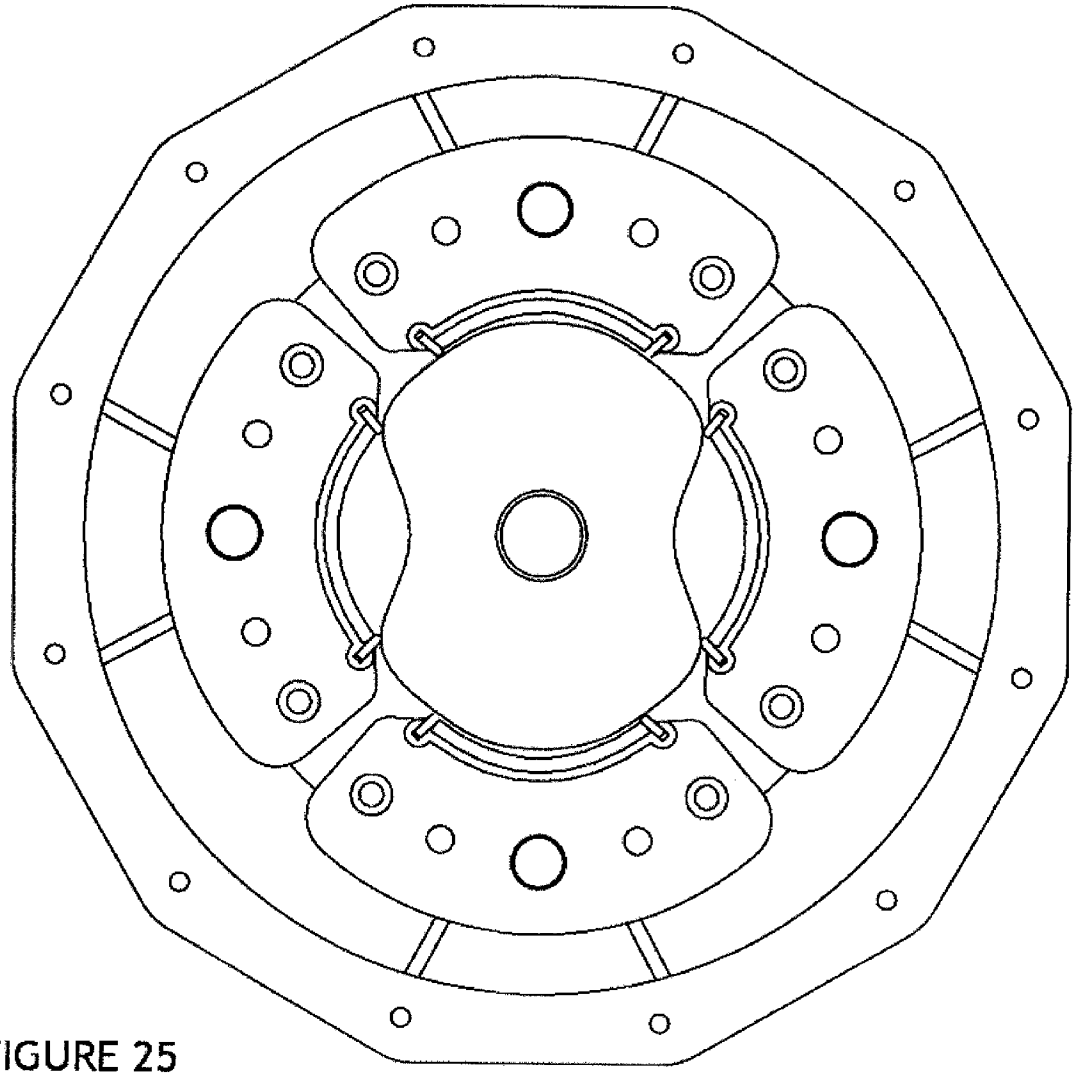
FIG. 25 illustrates an example of an engine design having four contours spaced apart ninety degrees.

FIG. 25 illustrates another embodiment of an engine having four contours that are spaced 90 degrees from each other about a rotatable island. The island defines two impressions therein that are spaced apart by 180 degrees for helping to define two parallel combustion chambers with two contours that are spaced 180 degrees apart. Thus, in one revolution the engine of FIG. 25 is able to provide four combustion events. As illustrated, as with the other contour assemblies illustrated herein, contours of FIG. 25 are defined by a pair of opposed outwardly facing arcuately shaped front and rear surfaces that are connected by a concave inwardly facing surface. The concave inwardly facing surface of the contour assemblies face the curved perimeter surface of the island.

FIGS. 11-24*b* provide illustrations of a further embodiment of a device in accordance with the disclosure.

Figures 11, 11A, 11B, 11C:
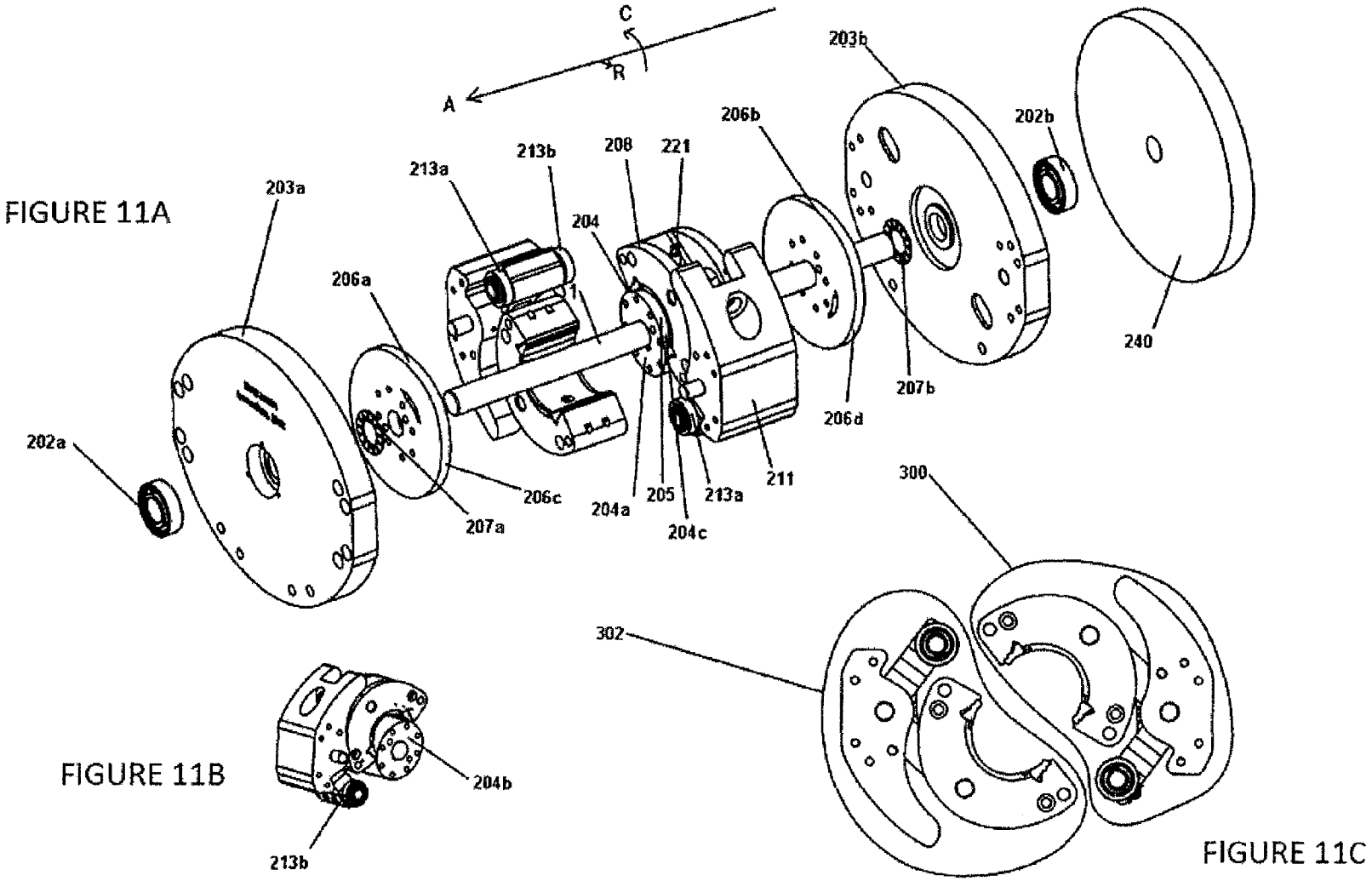
FIGS. 11A-11C illustrate an exploded, isometric view of a second embodiment in accordance with the disclosure.

Referring to FIG. 11, components are illustrated forming another embodiment of a IDAR engine. A coordinate system is also illustrated which will be utilized for discussing the disclosed embodiment. This coordinate system is a cylindrical, three dimensional system, consisting of axial (A), radial (R) and circumferential (C) axes. As illustrated in the Figure, a rotatable shaft 201 is held by a pair of front 202*a* and rear 202*b* radial frictionless/substantially frictionless, oil film or plain bearings. The bearings are supported by a pair of front 203*a* and rear 203*b* stationary case end plates.

The rotating shaft 201 is affixed to, or has integrated in it, a cylindrical-like shaped structure 204 or "island". The island, 204, is substantially thick and has two parallel flat surfaces 204*a* and 204*b*, as well as a perimeter surface 204*c* which is not round. The non-round shape surface, 204*c* can be elliptical, oval, egg like or a combination of curves and splines that form a closed, smooth convex path, such as disclosed herein with respect to the embodiment of FIGS. 1-10. This shape (i.e., the profile or planform projection of the island 204) can be symmetric or asymmetric in shape with respect to either a vertical or horizontal axis when viewed directly upon either flat surface. (See FIG. 12).

As further illustrated in FIG. 11, mechanically fastened to or integrated in front 204*a* and rear 204*b* flat ends or faces of the island 204 are a pair of front 206*a* and rear 206*b* side plates, such that a gas-tight seal is formed. The side plates 206*a*, 206*b* rotate with the shaft 201 but may or may not have a center of rotation that matches a geometric center of the side plates 206*a*, 206*b* and island 204 combination. Non-coincident rotating and geometric centers can produce the desirable effect of asymmetric working volume dynamic changes.

A pair of front 207*a* and rear 207*b* thrust bearings can be used to keep the island-side plate combination at a fixed axial location.

A concave-shaped part or "contour assembly" 208 is disposed between plates 206*a* and 206*b* such that the concave opening is facing the island 204 forming a working volume 205 therebetween. A pair of first 215*a* and second 215*b* apex points (FIG. 12), contact the convex surface of the island 204 and the parallel surfaces of the side plates 206*a*, 206*b*.

Figure 12:
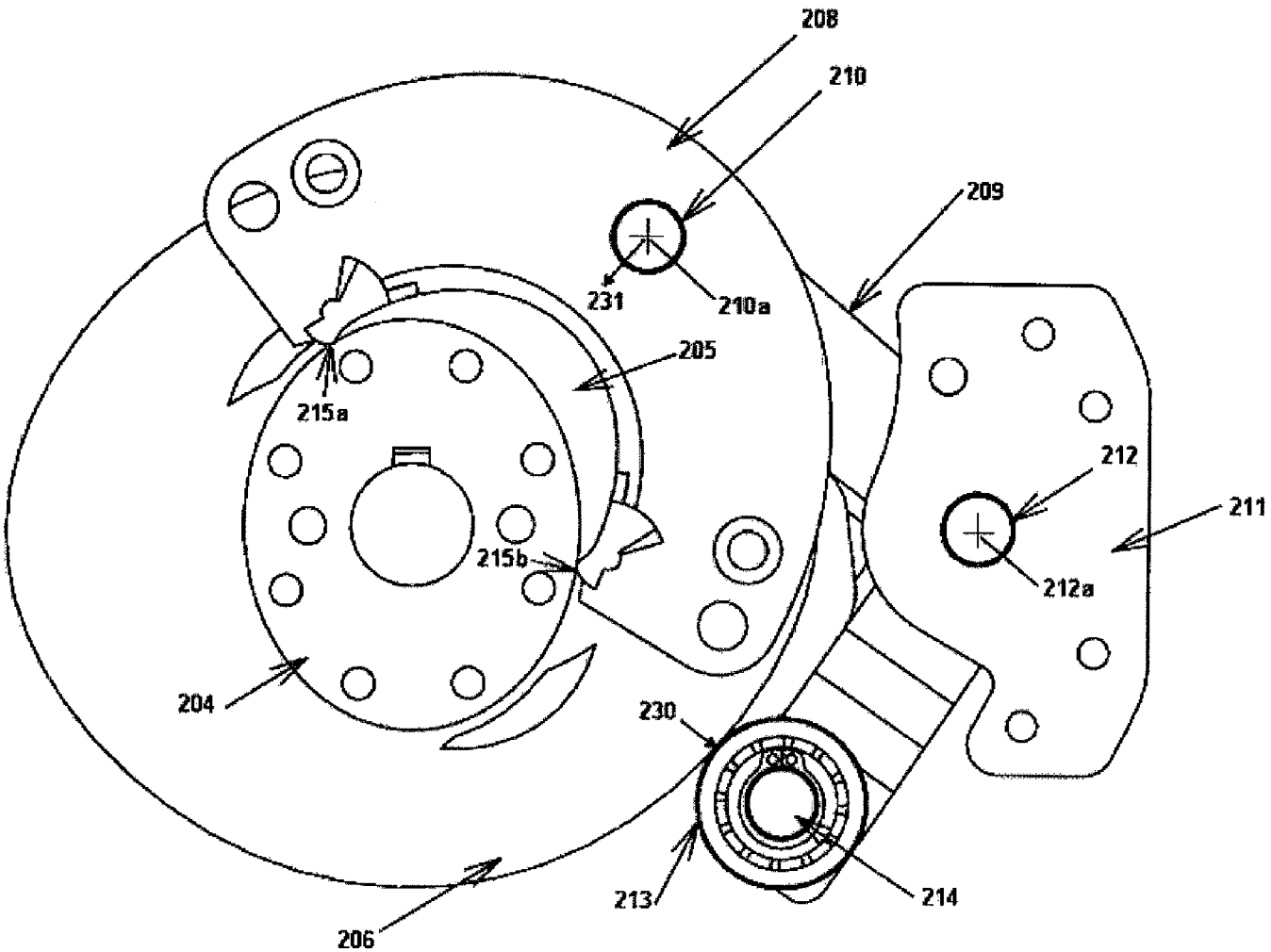
FIG. 12 illustrates a mechanical transfer detail of the embodiment of FIG. 11.

The parts illustrated in FIG. 12 define the motion of the contour assembly 208. The contour assembly 208 is operably connected to a lever 209, illustrated as being "L"-shaped (see FIG. 15), by use of a wrist pin 210. This connection allows the contour assembly 208 to pivot in the plane as viewed in FIG. 12 about the center 210*a*.

As further illustrated, lever 209 is attached to a fixed bracket 211 by way of a second wrist pin 212. Wrist pins 210 and 212 are disposed in a double shear mode that enables high rigidity in the structure.

Bracket 211 can be fastened to, or can be one and the same as, both of the stationary case end plates 203*a*, 203*b*. The second wrist pin 212 also only allows the lever 209 to pivot or rock in the plane as viewed in FIG. 12 about center 212*a*.

Continuing down the lever 209, the assembly further includes a pair of first 213*a* and second 213*b* (FIG. 1) cam followers, one for each side plate 206*a*, 206*b*. The cam followers 213*a*, 213*b* may be rotating bearings or sliding shoes. Cam follower bearings 213*a* and 213*b*, if so chosen, are allowed to rotate about an axle pin 214 (FIG. 12) and can be held on by clips or other structure. The cam followers 213*a*, 213*b* contact and thus follow the complex profile of the outer edge 206*c*, 206*d* of the side plates 206*a*, 206*b* (FIG. 11).

The motion of the contour assembly 208 is determined by two different mechanisms. To move the contour assembly 208 to the center, thereby reducing the working volume 205, the side plates 206*a*, 206*b* exert outward force 230 on the cam followers 213*a* and 213*b*. Through the fulcrum point 212*a* created at wrist pin 212, the outward cam force 230 is then translated to an inward force 231 at wrist pin 210, thus pushing the contour assembly 208 toward the center of the island 204.

Figures 14, 14A, 14B, 14C:
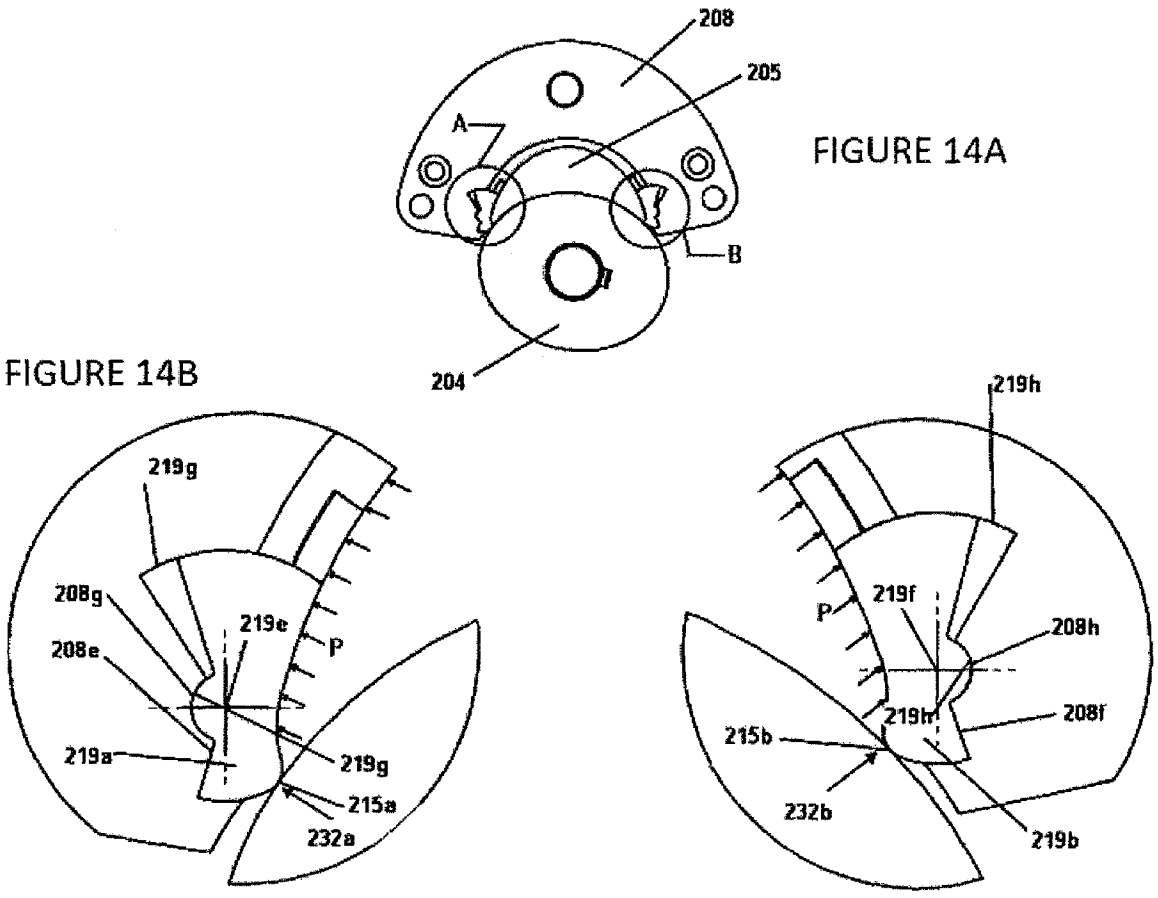
FIGS. 14A-14C illustrate rotating side plates of the embodiment of FIG. 11.

To increase the working volume 205, the pair of first 215*a* and second 215*b* contact points of the contour assembly 208 are pushed outward in the direction 232*a* and 232*b* of FIG. 14, by the rotational motion of the island 204.

The shape of the outer edges 206*c* and 206*d* of the side plates 206*a*, 206*b*, the shape of the outer surface 204*c* of the island 204 and the geometry of the lever 209 and contour assembly 208, together, minimize the free play between the motions of increasing and decreasing the working volume 205.

Figure 13:
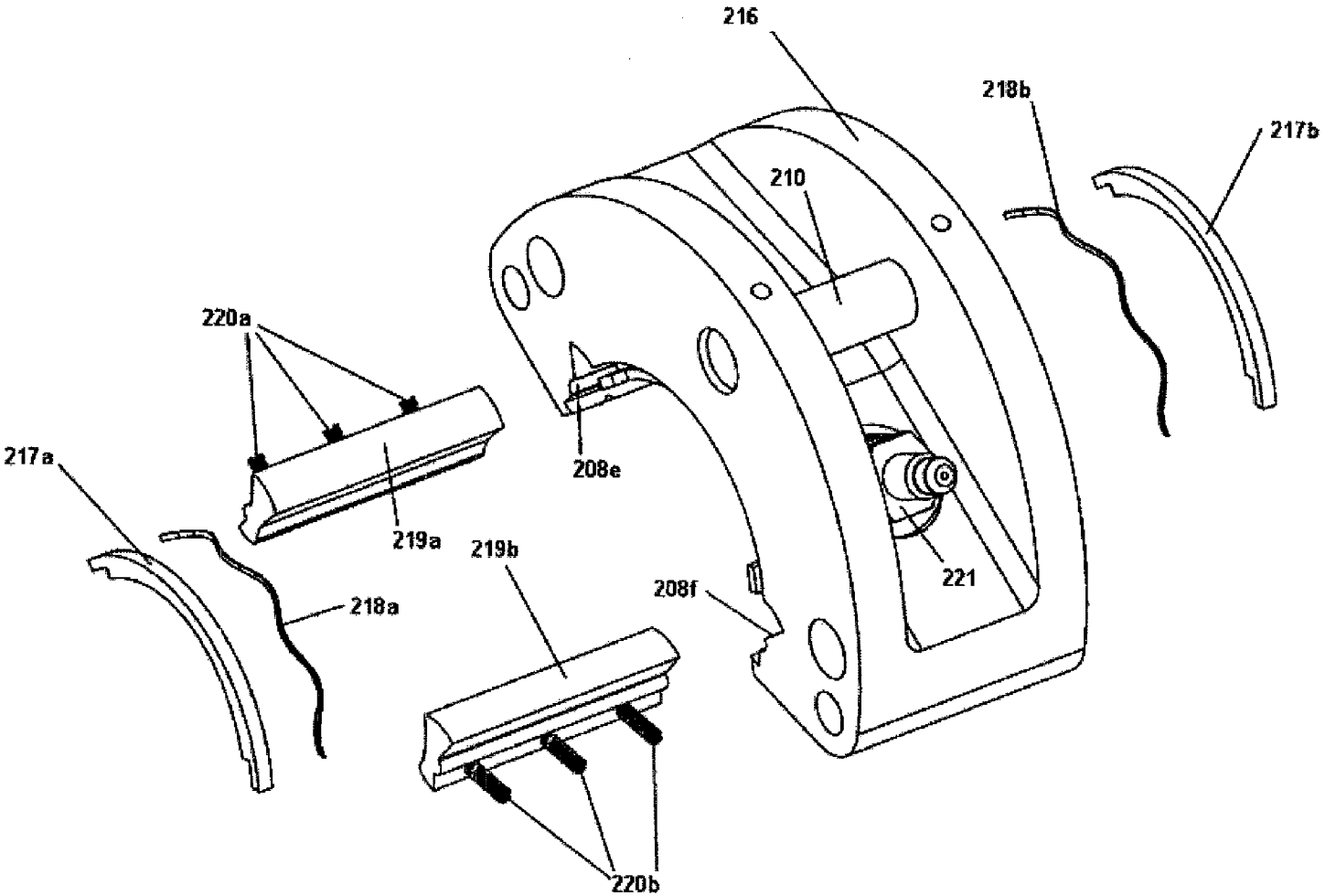
FIG. 13 illustrates contour parts of the embodiment of FIG. 11.

The contour assembly 208 as shown in FIG. 13, includes a main body 16 and additional parts, discussed below, to substantially prevent leakage of the working gases from the working volume defined between the island, the contour and the faces of the front and rear end plates. As illustrated, the assembly can include a spark plug 221 as shown in FIG. 13 and as described in the related text, below.

The main body 216 of the contour assembly 208 is narrower than the thickness of the island 204 and can be made of materials not conducive to wear. For example, main body 216 can be made from aluminum or other light weight materials. If desired, it could also be made from cast iron or forged steel. A gap, which can be sealed, is defined between the main body 216 of the contour assembly 208 (FIG. 1) and the adjacent side plates 206*a*, 206*b*. To bridge this gap and in order to substantially maintain gases within the working volume 205, the floating side seals 217*a*, 217*b* (FIG. 13) are imbedded in opposing flat faces 208*c*, 208*d* of the contour 208. The side seals 217*a*, 217*b* sit atop the preloading wavy springs 218*a*, 218*b*.

To prevent gases from leaking out the apex points 215*a*, 215*b* (FIG. 12), rotatable seals 219*a*, 219*b* as illustrated in FIG. 13 can be inserted into transverse, axially extending, matching channels 208*e* and 208*f* in the contour 208. The apex points 215*a*, 215*b* of the seals 219*a*, 219*b* contact the surface 204*c* of island 204 as shown in FIG. 12. The seals 219*a/b* and matching channels 208*e/f* are shaped to provide the seals 219*a/b* with a circumferential range of motion about pivot points 219*e/f*, as discussed below and as shown in FIG. 204.

For example, fulcrums 219*e*, 219*f*, can be created near the center of the seals 219*a*, 219*b* by convex arcs 219*g*, 219*h* that are concentric with second arcs 208*g/h* formed into each transverse cut 208*e* and 208*f* of the contour. This geometry allows the seals 219*a*, 219*b* to circumferentially rotate when viewed from the end as shown in FIG. 204. Furthermore, the distance between the fulcrum point 219*e* or 219*f* and apex points 2215*a* or 15*b* is substantially shorter than the distance between the fulcrum and the radiused ends 219*g* and 19*h* of the seals 219*a* and 219*b*.

Radially outwardly extending, preloading springs 220*a*, 220*b* (FIG. 13) preferably maintain a nominal seal contact force of the rotatable seals 219*a*, 219*b* at contact points 215*a* and 215*b*. For enhancing seal contact force, internal gas pressure P (FIG. 14) within working volume 205 creates an unbalanced load on the rotatable seals, thus increasing the seal contact force at 215*a* and 215*b* proportionally to the ratio of the above noted distances and the internal pressure P of the working volume 205.

Preloading springs, 220*a* and 220*b* furthermore assist in correcting for differences in the motion and wear at contact points 215*a*, 215*b*.

Figure 15:
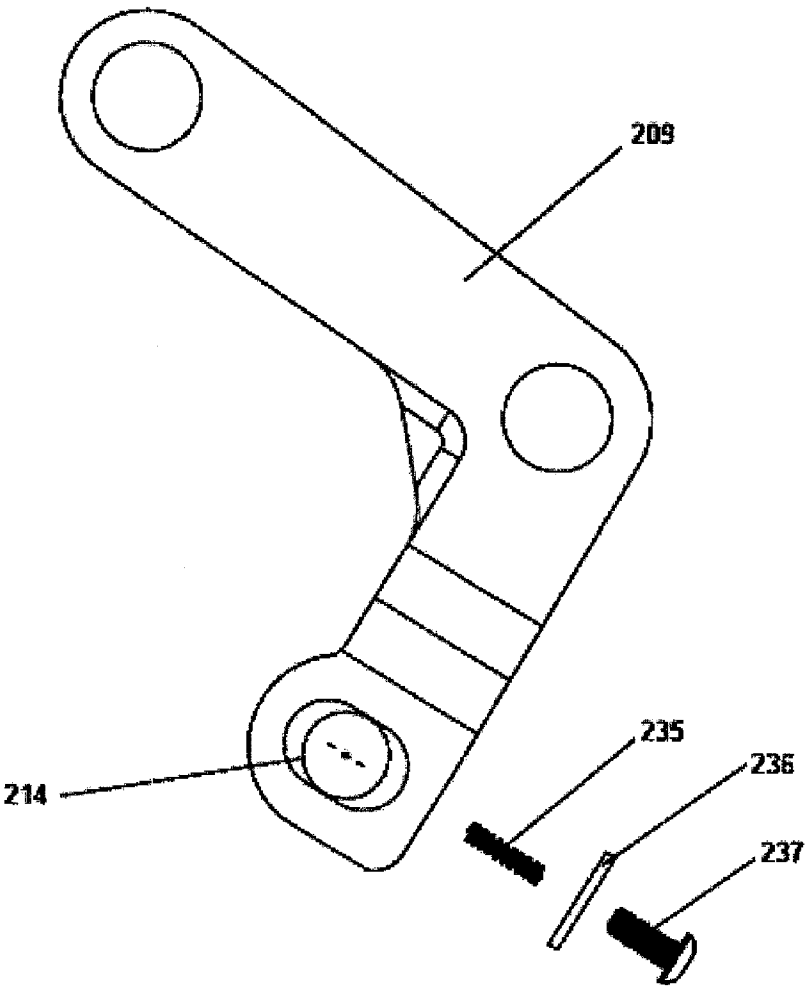
FIG. 15 illustrates a lever arm and compliant axle of the embodiment of FIG. 11.

Additional springs 235, shown in FIG. 15, contact with axle 214 to prevent "slapping" of the side plate surfaces 206*c* and 206*d* against cam follower bearings 213*a* and 213*b* that may be the result of motion error or wear. Springs 235 are held in place with retainer plate 236 and screws 237.

In a typical application, one to multiple copies of the sub assembly 300 shown in FIG. 11 may be used. As illustrated in FIG. 11, the disclosed embodiment uses two of the same sub assemblies 300, 302, each including contour assemblies 208*a*, 208*b* levers 209*a*, 209*b* and related parts identified above. The sub assemblies 300, 302 are rotationally separated by 180 degrees around the island 204. This symmetric construction dampens vibrations in the case and motor mounts.

In the case when the disclosed embodiment is used as an internal combustion engine, the ignition spark plug 221, located as centrally as possible in the contour 208 as shown in FIG. 13. A high voltage electrical spark is transferred to the center electrode of the sparkplug through a high voltage wire or other mechanism not shown. The high voltage electrical pulse is created in a magneto, electronic ignition coil or other conventional components not shown, and timed to the rotational position of the shaft.

Working gases such as fresh air-fuel mixtures or exhaust are conveyed into and out of the working volume 205 with ports located in the side plates 206*a* and 206*b*. The ports may include, but are not limited to, those illustrated in FIG. 16. Side plate 206*a*, 206*b* have specially shaped through-openings 222*a*, 222*b*, which as the island 204 and side plates 206*a*, 206*b* assembly rotates, come into view of the working volume 205. Such openings 222 were described in U.S. patent application Ser. No. 12/732,160, filed on Mar. 25, 2010 incorporated herein by reference in its entirety in which the contours 208 revolved around the fixed island 204. As indicated, while the island 204 revolves in the embodiment disclosed herein, the covering and exposing ports is still accomplished by the movement of the contour(s) 208. The shapes of the openings 222*a*, 222*b* are optimized to enhance flow timing, seals traversing over ports and parasitic losses.

Incidentally, smaller through-hole openings in FIG. 16 are mounting openings as discussed in the '160 application.

When Used as an Internal Combustion (I.C.) Engine

When the embodiment of FIG. 11 et seq. is used to convert chemical energy to rotational kinetic energy, a four stroke cycle is preferably used, and one complete cycle can be performed in one shaft revolution. If two contour assemblies 300 and 302 are used as shown in FIG. 11, a total of two complete cycles can be performed in one revolution. Flywheel 240 illustrated in FIG. 11 is also added to store rotational energy.

Side plates 206*a*, 206*b*, may have typically single port openings 222*a* or 222*b*. The angular locations of each port with respect to a single common indicia on the shaft 201, and the locations of the contour assemblies 208, determine the function of each port. The angular location=0 degrees will be set at the start of the intake stroke for these discussions.

Figure 17:
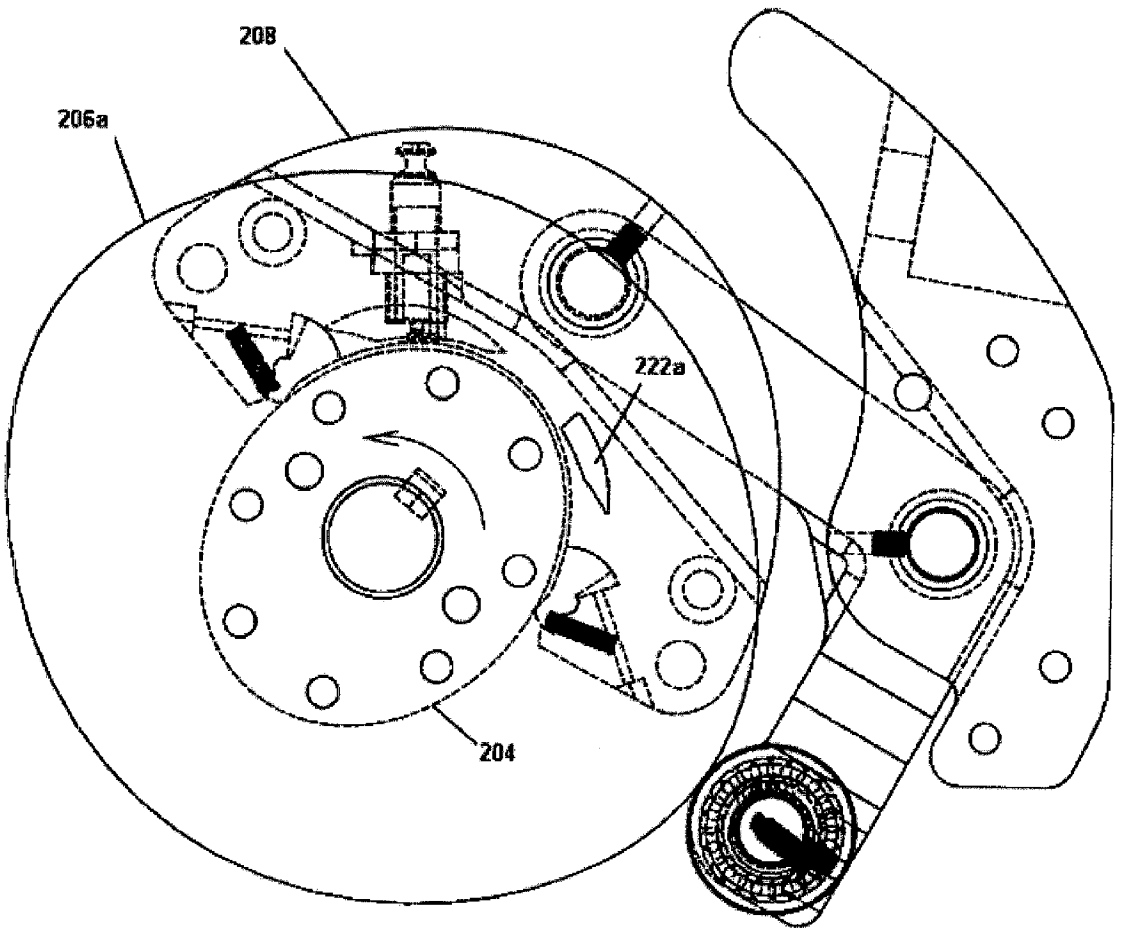
FIG. 17 illustrates one aspect of various operations of the C.E./pump of FIG. 11.

Intake Stroke:

FIG. 17 shows the point in rotation where the working volume is at a minimum. A port designated as the intake port, for example, port 222*a*, starts to become exposed in the rotating side plate 206*a* (note arrow for rotation direction) when viewed to the relative movement of the island 204 and the contour assembly 208 to the working volume 205. Port 222*a* is externally connected to a fresh air source to which a means to inject or induce fuel, such as gasoline, propane or methane (or natural) gas into such air stream. This allows the combustible mixture of fuel and air to be suctioned into the working volume 205, which is increasing at the same time.

Figure 18A:
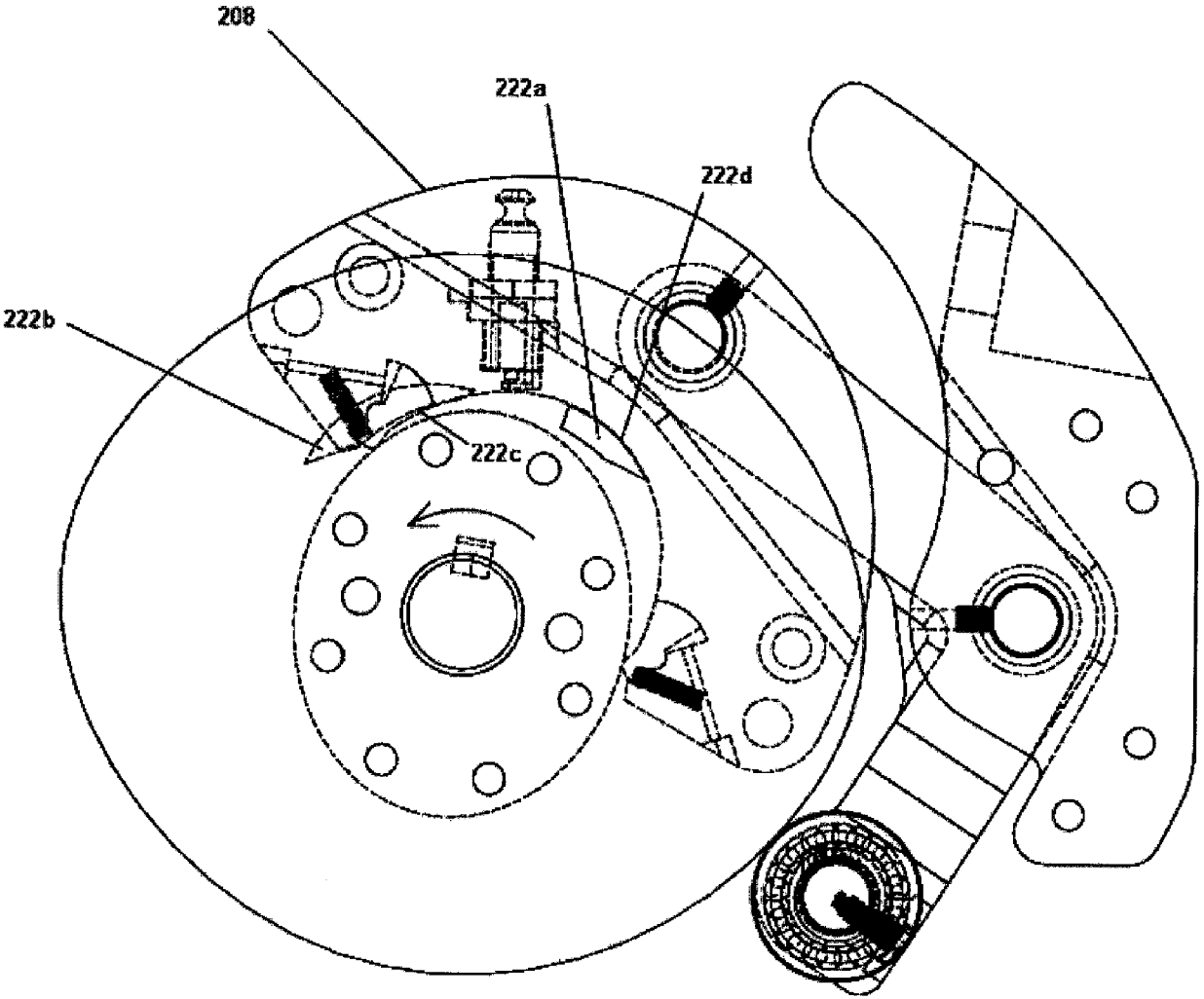
FIGS. 18A-18B illustrate further aspects of various operation of the C.E./pump of FIG. 11.

The island 204 continues to rotate as shown in FIG. 18A. At this point, the radially inner edge 222*c* of exhaust port 222*b*, which is circumferentially trailing in the direction of motion, is now aligned with the radially inner edge of the contour 208, so as to close exhaust port 222*b*. In addition, the radially outermost edge 222*d* of the port 222*a*, which is the circumferentially trailing direction of motion, becomes aligned with the radially inner edge of the contour 8, maximizing the opening of the port 222*a* though the cycle.

Figure 18B:
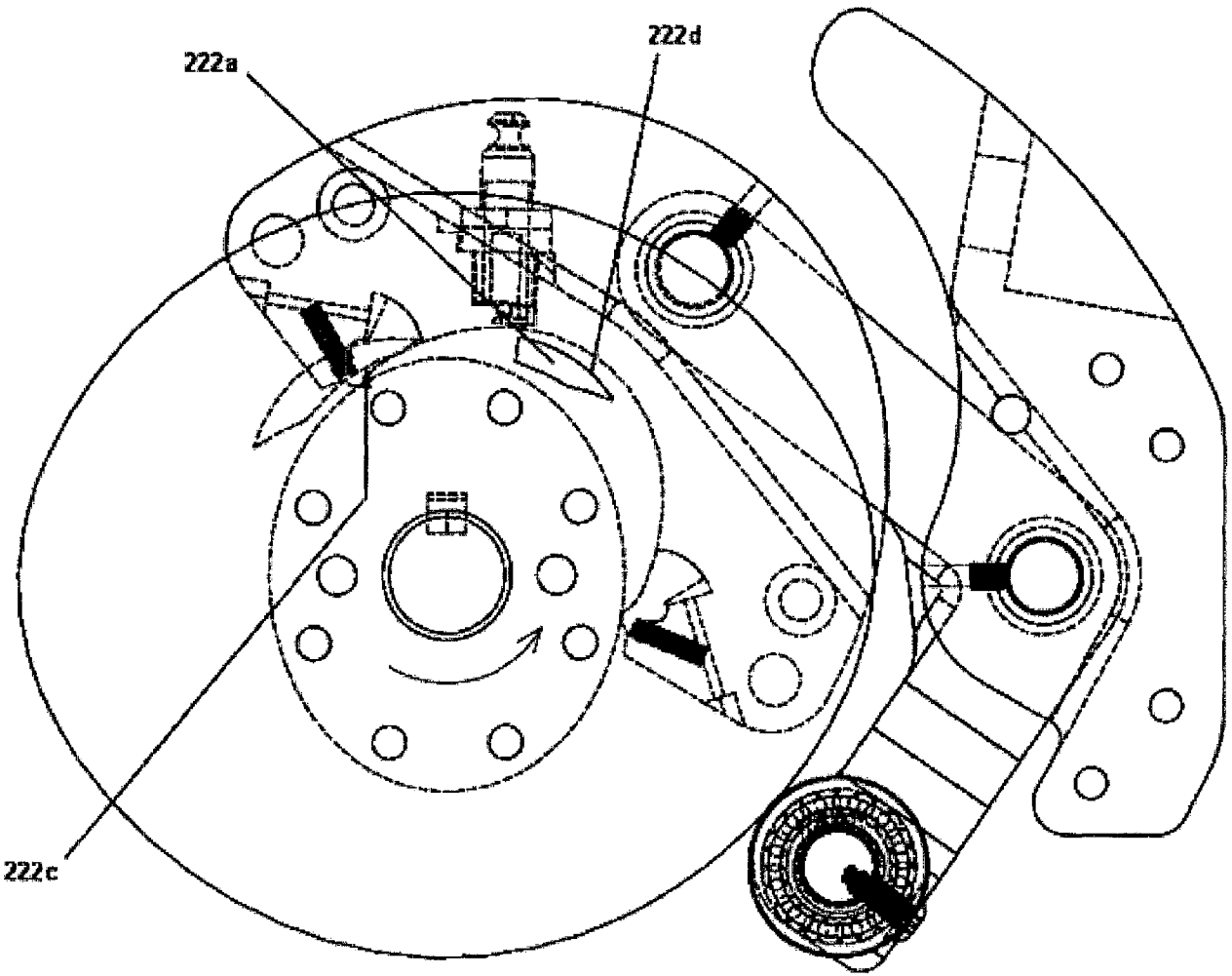
Figure 19:
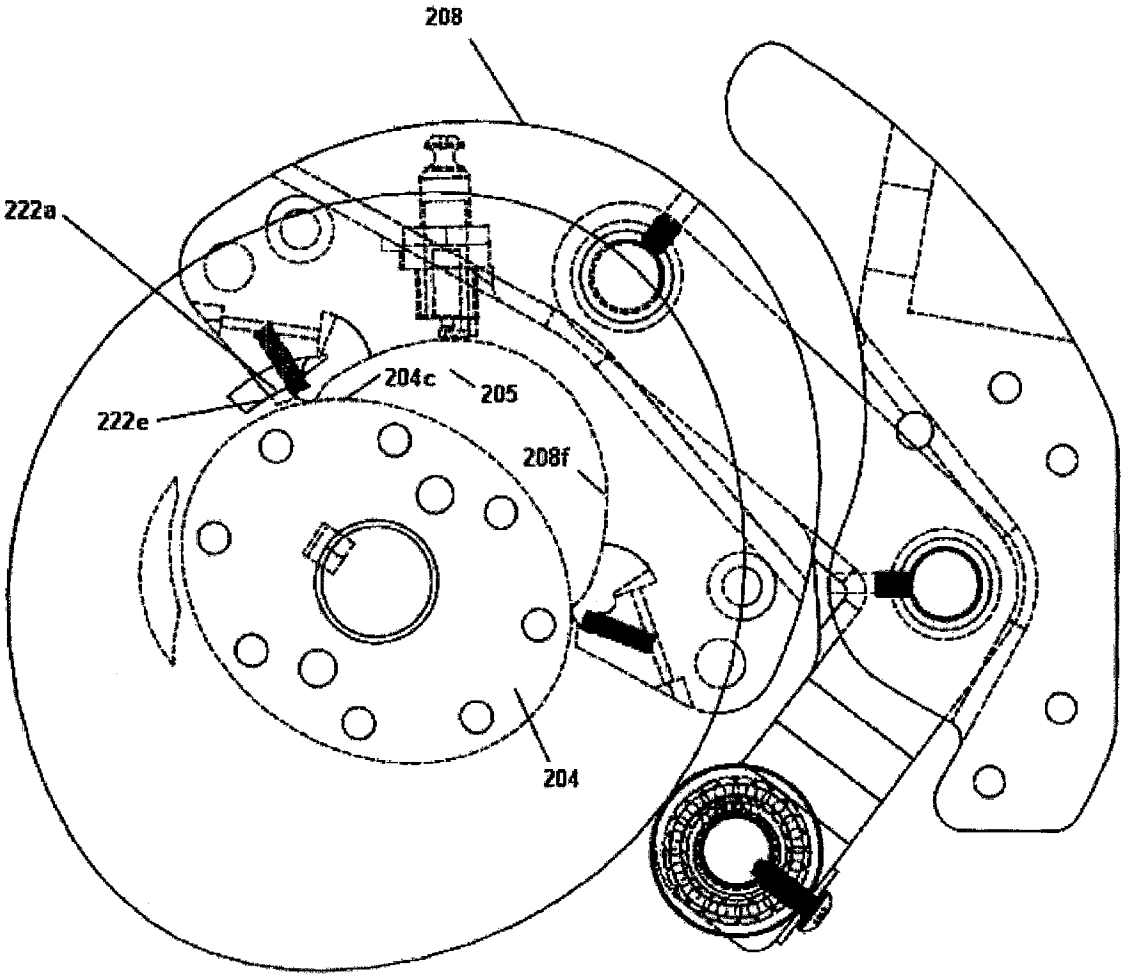
FIG. 19 illustrates a further aspect of various operation of the C.E./pump of FIG. 11.

FIG. 18B shows the rotation at 45 degrees and indicates that the intake port 222*a* is fully engaged in allowing air and fuel to enter the working volume.

Progressing further to 90 degrees, the radially inner edge 222*e* of intake port 222*a*, which is in the circumferentially trailing direction of motion, becomes aligned with the radially inner edge of the contour 208 as illustrated in FIG. 209, closing the intake port. FIG. 209 shows the maximum volume point for the working volume 205. The maximum volume results when, due to relative movement of the island 204 and the contour assembly 208, a maximum void exists between the island facing surface of the contour assembly 208*f* of FIG. 18 and the contour facing surface of the island 204*c*. Coincidently, the port 222*a* is no longer open to the working volume due to the rotation of the island-side plate assembly and the movement of the contour assembly.

Figure 20:
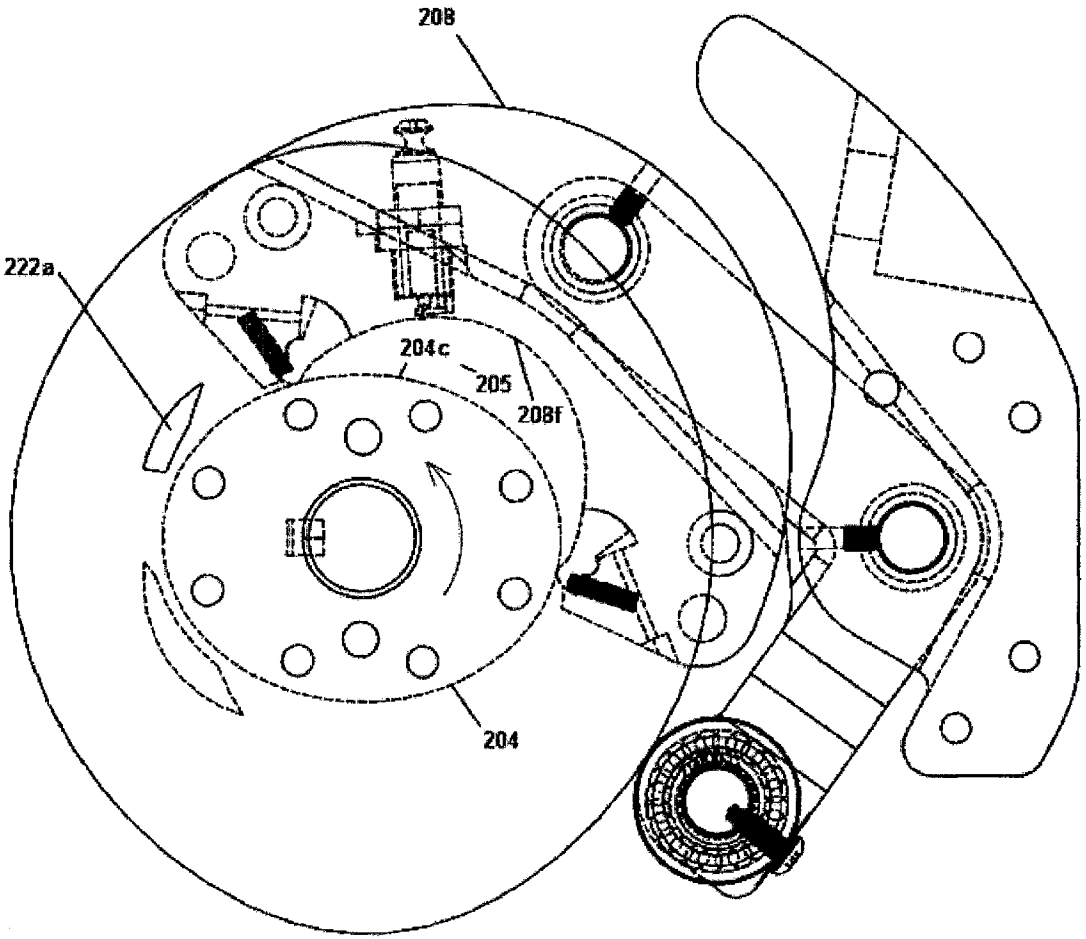
FIG. 20 illustrates a further aspect of various operation of the C.E./pump of FIG. 11.
Figure 21:
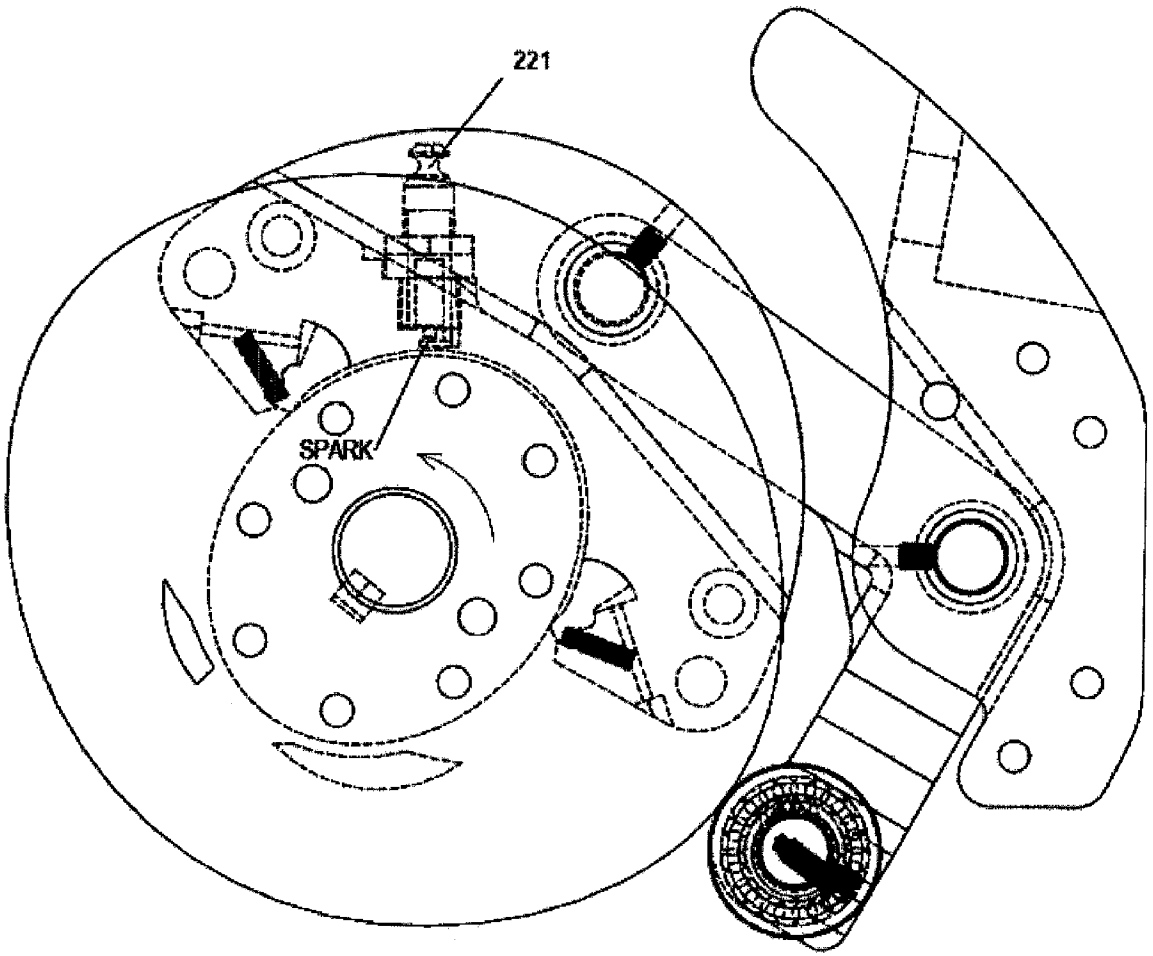
FIG. 21 illustrates a further aspect of various operation of the C.E./pump of FIG. 11.

Compression Stroke:

FIG. 20 shows the intake port 222*a* rotated beyond the working volume, i.e., closed. Stored rotational energy from a flywheel 240 of FIG. 11 forces the continued rotation of the island 204 and forces contour assembly 208 to constrict the working volume 205 though the side plate, cam follower and lever mechanism. This compresses the gas mixture. Due to continued relative movement of the island 204 and contour assembly 208, compression continues until a minimum void exists between the island facing surface of the contour assembly 8*f* and the contour facing surface of the island 204*c*, until the working volume 205 reaches its minimum volume shown in FIG. 21.

Figure 22:
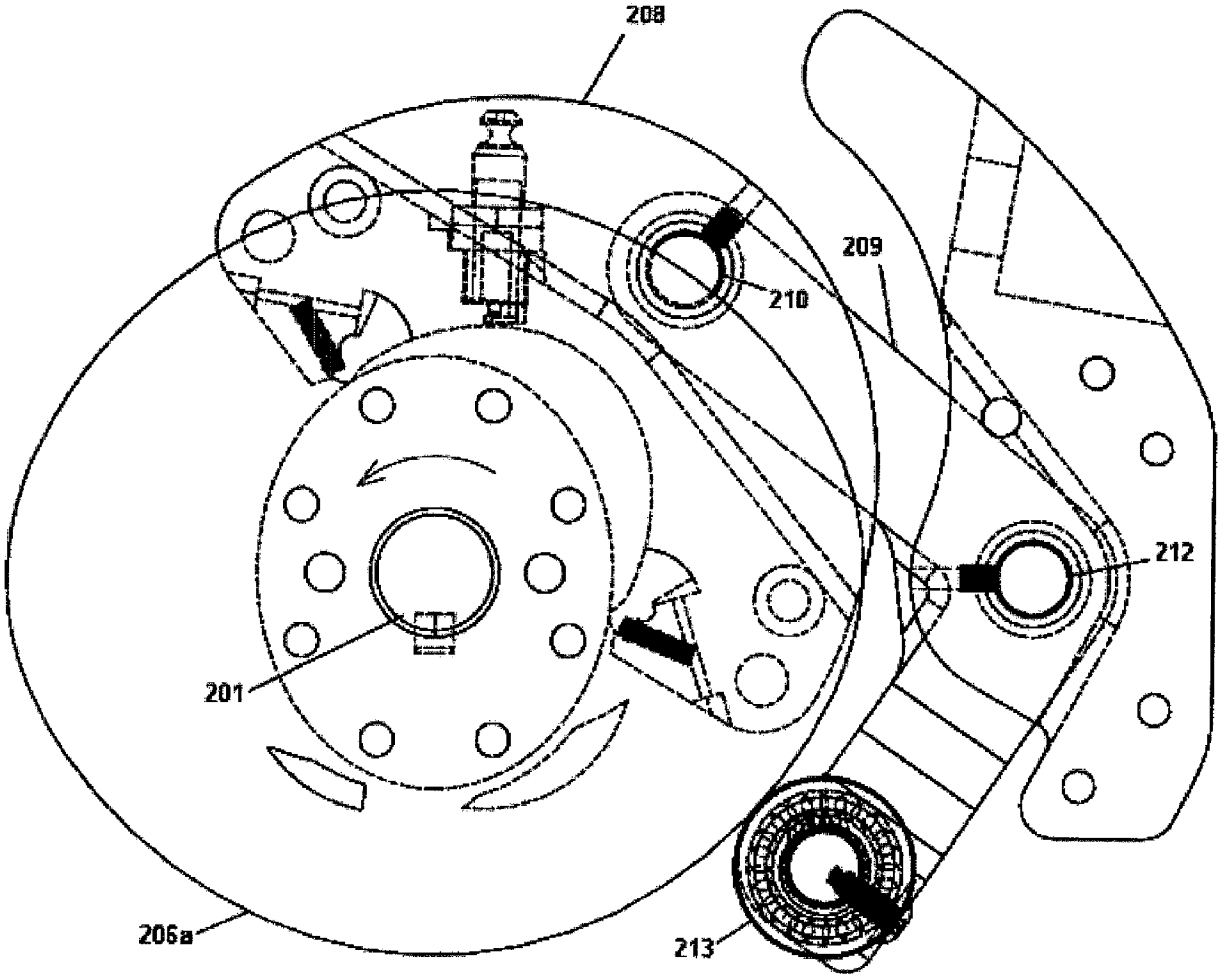
FIG. 22 illustrates a further aspect of various operation of the C.E./pump of FIG. 11.

Power Stroke:

When the working volume 205 is near or at a minimum (FIG. 21), the spark plug 221 is energized from an external high voltage coil and the fuel-air mixture is ignited. All ports remain closed at this time. The rapidly burning, expanding gases begin pushing the contour 208 outward as shown in FIG. 22. The force is transmitted through the wrist pin 20, and into lever 209. Lever 209 rotates about wrist pin 212 and imparts the force onto cam follower wheels 213. The cam action pushes the side plates 206*a*, 206*b* in a rotary motion and the shaft 201 turns thus creating useful rotational power.

Figure 23:
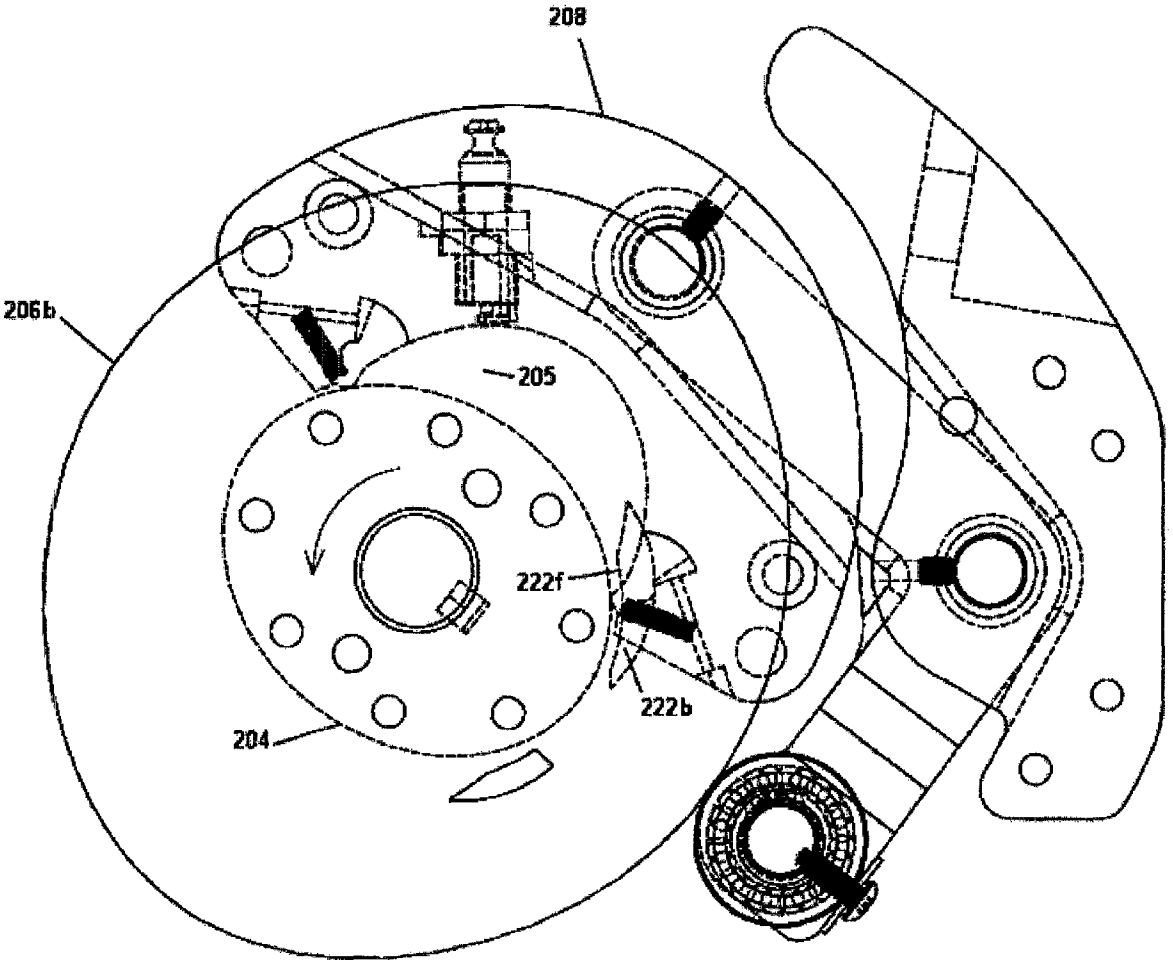
FIG. 23 illustrates a further aspect of various operation of the C.E./pump of FIG. 11.
Figure 24A:
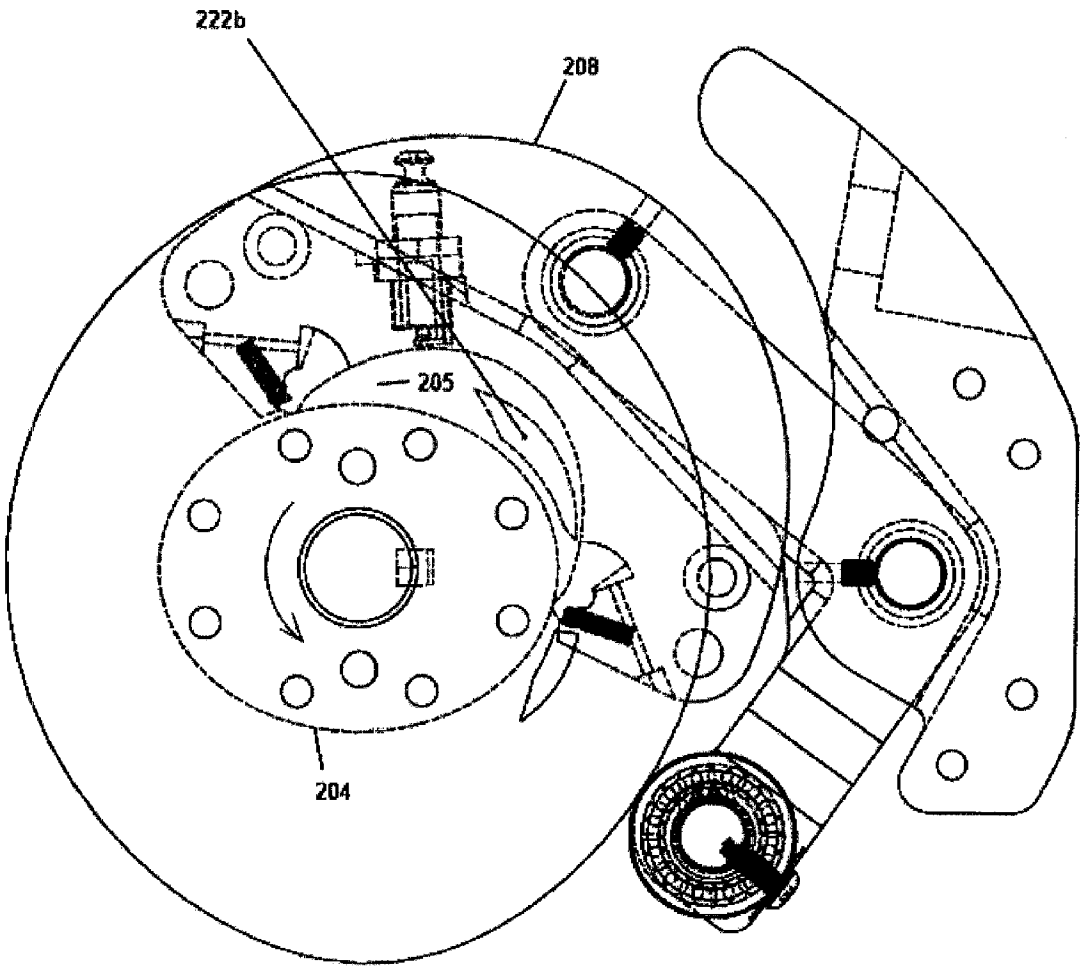
FIGS. 24A-24B illustrate still further aspects of various operation of the C.E./pump of FIG. 11.

Exhaust Stroke:

After the working volume 205 reaches its maximum as shown in FIG. 23, the radially inner edge 222*f* of exhaust port 222*b*, which is in the leading direction of motion, and which is located on side plate 206*b*, begins to be exposed to the working volume 205 due to relative movement of the island 204 and the contour assembly 208. Positive power transmission ceases. Port 222*b* gradually then fully opens as shown in FIG. 24A due relative movement of the island 204 and the contour assembly 208, and the spent gases are pushed out port 222*b* and into the exhaust system to atmosphere, as the working volume 205 decreases.

Figure 24B:
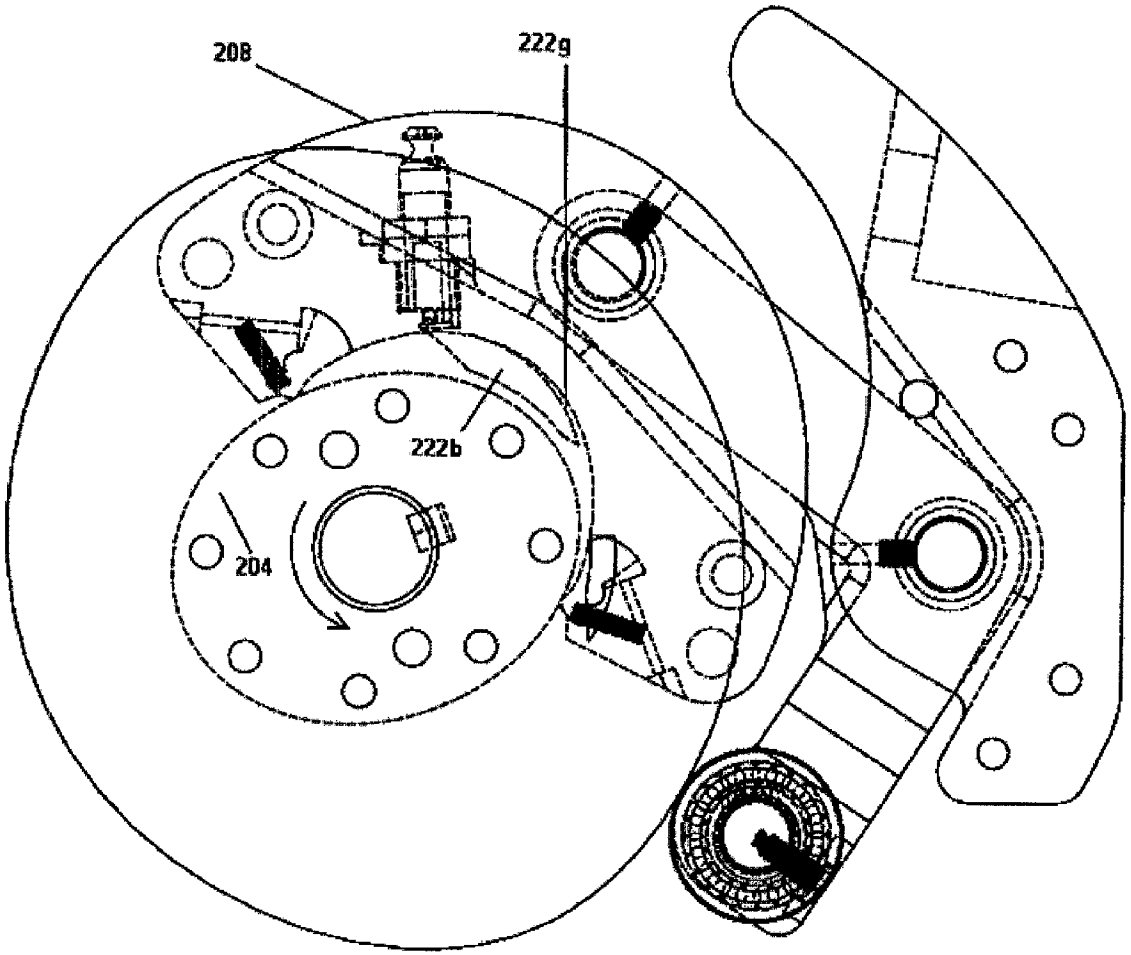

FIG. 24B shows the radially outer edge 222*g* of the port 222*b* is shaped to provide for maximum opening as the contour 208 moves against the island 204 during the later part of the exhaust stage. Exhaustion continues to occur through to the beginning of the intakes cycle, when both ports 222*a*, 222*b* are not within the working volume 205. At the point when the working volume 205 can get no smaller, the cycle is repeated with the intake stroke as shown in FIG. 17 and repeated in the related text.

In similar fashion but approximately 180 degrees out of phase, contour assembly 302 is repeating the above four stroke cycle using the same ports that were used for assembly 300.

The shape of the island 204 can be chosen to modify the variation in working volume over the engine cycle so as to exhibit a power stroke maximum volume which is larger than the intake stroke maximum volume. Additionally, the length and closing point of intake port 222*a* can be modified to simulate a smaller intake stroke volume. When the expansion volume is larger than the intake volume, it is said to be an "Atkinson Cycle". The ratio of the expansion volume over the intake volume is known as Atkinson ratio. Ratios significantly greater than 1.0 can produce higher fuel efficiency combustion engines. Particular geometry details of the invention can be easily modified to boost the Atkinson ratio well over 1.0.

Although the present disclosure herein has been described with reference to particular preferred embodiments thereof, it is to be understood that these embodiments are merely illustrative of the principles and applications of the disclosure. Therefore, modifications may be made to these embodiments and other arrangements may be devised without departing from the spirit and scope of the disclosure.

What is claimed is:

1. A rotary machine, comprising:

a) a rotatable crankshaft main shaft defining a central axis having an island disposed thereon, the island having a body with a volume generally defined between front and rear surfaces that are spaced apart along the main shaft, the front and rear surfaces lying in a plane parallel to a radial axis perpendicular to the central axis, the front and rear surfaces having a rounded, non-circular shape, the perimeters of the front and rear surfaces defining a curved peripheral surface therebetween;

b) a front side plate disposed at the front surface of the island;

c) a rear side plate disposed at the rear surface of the island, the front and rear side plates being integrated with the island and main shaft such that the front and rear side plates always rotate with the main shaft and island during operation of the rotary machine; and d) a contour assembly disposed between the front side plate and the rear side plate rotatably mounted to a stationary housing, the contour assembly having a body defining a concave inwardly facing surface that faces the curved peripheral surface of the island, the concave inwardly facing surface, the curved peripheral surface of the island, the front side plate and the rear side plate cooperating to form a working volume, the main shaft and the island being configured to rotate with respect to the contour assembly, the movement of the contour assembly being defined by oscillation about a single rotational mount as the island, the main shaft, the front side plate and the rear side plate rotate about the central axis, the contour assembly including a first apex seal disposed at a first end of the contour assembly and a second apex seal disposed at a second end of the contour assembly, the contour assembly further having at least one rolling cam follower attached to the contour assembly, the at least one rolling cam follower being configured to ride along a cam shaped pathway integrated with at least one of the front side plate and the rear side plate, the curved peripheral surface of the island and the cam shaped pathway being complementarily configured to maintain a substantially uniform gap between the ends of the contour and the island when the island is rotating about the central axis.

2. A compressed air driven engine according to the rotary machine of claim 1.

3. The rotary machine of claim 1, wherein the contour assembly defines an opening therethrough for receiving a spark plug.

4. The rotary machine of claim 1, wherein the contour assembly is mounted to a stationary wrist pin, the contour assembly being able to oscillate about the wrist pin as the island, the main shaft, the front side plate and the rear side plate rotate about the central axis, the centerline of the wrist pin being oriented along an axis that is generally parallel to the central axis.

5. The rotary machine of claim 1, wherein the contour assembly further includes a first corner seal disposed proximate to a front face of the contour assembly and a second corner seal disposed proximate to a rear face of the contour assembly, the first and second corner seals being disposed in a channel defined between the front and rear faces of the contour assembly and the front and rear side plates, the first and second corner seals helping to define the working volume.

6. The rotary machine of claim 5, wherein the contour assembly further includes a plurality of floating side seals embedded in arcuate grooves defined in the front and rear faces of the contour assembly, the floating side seals providing sealing between the contour assembly and the front side plate and rear side plate during operation of the rotary machine.

7. The rotary machine of claim 1, further comprising a front thrust bearing in operable communication with the front side plate and a rear thrust bearing in operable communication with the rear side plate, the front and rear thrust bearings being configured to maintain the front side plate, the rear side plate, and the island in a substantially fixed axial location with respect to a stationary housing of the rotary machine when the rotary machine is operating.

8. The rotary machine of claim 1, wherein the island includes at least one port formed through the curved peripheral surface of the island for directing working fluid into or out of the working volume.

9. The rotary machine of claim 1, wherein the rotary machine is a pump.

10. The rotary machine of claim 1, wherein the rotary machine is a compressor.

11. The rotary machine of claim 1, wherein the rotary machine is an air conditioning compressor configured to compress refrigerant.

12. The rotary machine of claim 1, wherein the rotary machine is a steam driven engine.

13. A rotary machine, comprising:

a) a rotatable main shaft defining a central axis having an island disposed thereon, the island having a body with a volume generally defined between front and rear surfaces that are spaced apart along the main shaft, the front and rear surfaces lying in a plane parallel to a radial axis perpendicular to the central axis, the front and rear surfaces having a rounded, non-circular shape, the perimeters of the front and rear surfaces defining a curved peripheral surface therebetween;

b) a front side plate disposed at the front surface of the island, the front side plate having a first cam-shaped perimeter;

c) a rear side plate disposed at the rear surface of the island, the rear side plate having a second cam-shaped perimeter; and d) a contour assembly disposed between the front side plate and the rear side plate, the contour assembly having:

(i) a body defining a concave inwardly facing surface that faces the curved peripheral surface of the island;

(ii) a front side facing the front side plate;

(iii) a rear side facing the rear side plate;

(iv) a first cam follower extending outwardly from the contour assembly including a first rotating bearing disposed on a first spindle attached to the contour assembly, wherein the first rotating bearing of the first cam follower rolls along and follows the first cam shaped perimeter of the front side plate to maintain substantially uniform spacing between the contour assembly and curved peripheral surface of the island when the island, the main shaft, the front side plate and the rear side plate rotate about the central axis with respect to the contour assembly; and (v) a second cam follower extending outwardly from the contour assembly including a second rotating bearing disposed on a second spindle attached to the contour assembly, wherein the second rotating bearing of the second cam follower rolls along and follows the second cam shaped perimeter of the rear side plate to maintain substantially uniform spacing between the contour assembly and the curved peripheral surface of the island when the island, the main shaft, the front side plate and the rear side plate rotate with respect to the contour assembly about the central axis, wherein the concave inwardly facing surface of the contour assembly, the curved peripheral surface of the island, the front side plate and the rear side plate cooperate to form a working volume.

14. A compressed air driven engine according to the rotary machine of claim 13.

15. The rotary machine of claim 13, wherein the contour assembly defines an opening therethrough for receiving a spark plug.

16. The rotary machine of claim 13, wherein the contour assembly is coupled to a stationary housing.

17. The rotary machine of claim 13, wherein the contour assembly is mounted to a stationary wrist pin, the contour assembly being able to oscillate about the wrist pin as the island, the main shaft, the front side plate and the rear side plate rotate about the central axis, the centerline of the wrist pin being oriented along an axis that is generally parallel to the central axis.

18. The rotary machine of claim 13, wherein the contour assembly includes a first apex seal disposed proximate to a first end of the concave inwardly facing surface of the contour assembly and a second apex seal disposed proximate to a second end of the concave inwardly facing surface of the contour assembly, the first and second apex seals being disposed in a gap defined between the concave inwardly facing surface of the contour assembly and the curved peripheral surface of the island, the first and second apex seals helping to define the working volume.

19. The rotary machine of claim 18, wherein the contour assembly further includes a first corner seal disposed proximate to a front face of the contour assembly and a second corner seal disposed proximate to a rear face of the contour assembly, the first and second corner seals being disposed in a channel defined between the front and rear faces of the contour assembly and the front and rear side plates, the first and second corner seals helping to define the working volume.

20. The rotary machine of claim 19, wherein the contour assembly further includes a plurality of floating side seals embedded in arcuate grooves defined in the front and rear faces of the contour assembly, the floating side seals providing sealing between the contour assembly and the front side plate and the rear side plate during operation of the rotary machine.

21. The rotary machine of claim 13, further comprising a front thrust bearing in operable communication with the front side plate and a rear thrust bearing in operable communication with the rear side plate, the front and rear thrust bearings being configured to maintain the front side plate, the rear side plate, and the island in a substantially fixed axial location with respect to a stationary housing during operation of the rotary machine.

22. The rotary machine of claim 13, wherein the island includes at least one port formed through the curved peripheral surface of the island for directing working fluid into or out of the working volume.

23. The rotary machine of claim 13, wherein the rotary machine is a pump.

24. The rotary machine of claim 13, wherein the rotary machine is a compressor.

25. The rotary machine of claim 13, wherein the rotary machine is an air conditioning compressor configured to compress refrigerant.

26. The rotary machine of claim 13, wherein the rotary machine is a steam driven engine.

27. A rotary machine, comprising:

a) a rotatable main shaft defining a central axis having an island disposed thereon, the island having a body with a volume generally defined between front and rear surfaces that are spaced apart along the main shaft, the front and rear surfaces lying in a plane parallel to a radial axis perpendicular to the central axis, the front and rear surfaces having a rounded, non-circular shape, the perimeters of the front and rear surfaces defining a curved peripheral surface therebetween;

b) a front side plate disposed at the front surface of the island;

c) a rear side plate disposed at the rear surface of the island, the front and rear side plates being attached to at least one of the main shaft and the island such that the front and rear side plates always rotate with the main shaft and the island during engine operation of the rotary machine;

d) a contour assembly disposed between the front side plate and the rear side plate, the contour assembly having a body defining a concave inwardly facing surface that faces the curved peripheral surface of the island, the concave inwardly facing surface, the curved peripheral surface of the island, the front side plate and the rear side plate cooperating to form a working volume, the main shaft and island being configured to rotate with respect to the contour assembly; and e) a first cam follower extending outwardly from the contour assembly including a first rotating bearing disposed on a first spindle attached to the contour assembly, wherein the first rotating bearing of the first cam follower rolls along and follows a cam shaped perimeter of the front side plate to maintain substantially uniform spacing between the contour assembly and curved peripheral surface of the island when the island, the main shaft, the front side plate and the rear side plate rotate about the central axis with respect to the contour assembly.

* * * * *